US011530703B2

(12) United States Patent
Nicholas et al.

(10) Patent No.: US 11,530,703 B2
(45) Date of Patent: Dec. 20, 2022

(54) ORBITING SCROLL DEVICE LUBRICATION

(71) Applicant: Air Squared, Inc., Broomfield, CO (US)

(72) Inventors: Nathan D. Nicholas, Westminster, CO (US); Bryce R. Shaffer, Denver, CO (US); John P. D. Wilson, Denver, CO (US)

(73) Assignee: Air Squared, Inc., Broomfield, CO (US)

( * ) Notice: Subject to any disclaimer, the term of this patent is extended or adjusted under 35 U.S.C. 154(b) by 379 days.

(21) Appl. No.: 16/400,921

(22) Filed: May 1, 2019

(65) Prior Publication Data

US 2020/0025204 A1 Jan. 23, 2020

Related U.S. Application Data

(60) Provisional application No. 62/699,834, filed on Jul. 18, 2018.

(51) Int. Cl.
*F04C 29/02* (2006.01)
*F04C 18/02* (2006.01)
(Continued)

(52) U.S. Cl.
CPC ..... *F04C 29/028* (2013.01); *F01C 21/04* (2013.01); *F04C 18/0215* (2013.01);
(Continued)

(58) Field of Classification Search
CPC .. F04C 29/028; F04C 18/0215; F04C 27/009; F04C 29/023; F04C 2240/50;
(Continued)

(56) References Cited

U.S. PATENT DOCUMENTS 801,182 A 10/1905 Creux
2,079,118 A 5/1937 Hingst
(Continued)

FOREIGN PATENT DOCUMENTS

CN 1314899 5/2007
CN 103790826 5/2014
(Continued)

OTHER PUBLICATIONS

International Preliminary Report on Patentability for International (PCT) Patent Application No. PCT/US2018/064427, dated Nov. 19, 2020 8 pages.

(Continued)

*Primary Examiner* — Dominick L Plakkoottam
*Assistant Examiner* — Paul W Thiede
(74) *Attorney, Agent, or Firm* — Sheridan Ross P.C.

(57) ABSTRACT

A scroll device includes a fixed scroll with an idler shaft bearing, an orbiting scroll with another idler shaft bearing; and an eccentric idler shaft having first and second arms extending in opposite directions and ending at first and second ends, the first and second arms supported by the fixed scroll idler shaft bearing and the orbiting scroll idler shaft bearing, respectively. The eccentric idler shaft has a hollow core extending from the first end to the second end, with at least one channel extending through the first arm and enabling fluid communication between the hollow core and the at least one first bearing, and at least one second channel extending through the second arm and enabling fluid communication between the hollow core and the least one second bearing.

20 Claims, 11 Drawing Sheets

(51) Int. Cl.

| | |
|---|---|
| ***F01C 21/04*** | (2006.01) |
| ***F01C 1/02*** | (2006.01) |
| ***F01C 19/12*** | (2006.01) |
| ***F04C 27/00*** | (2006.01) |

(52) U.S. Cl.
CPC ..... *F01C 1/0215* (2013.01); *F01C 19/125* (2013.01); *F04C 27/009* (2013.01); *F04C 29/023* (2013.01); *F04C 2240/50* (2013.01); *F04C 2240/52* (2013.01)

(58) Field of Classification Search
CPC .. F04C 2240/52; F04C 18/0253; F04C 27/00; F04C 29/04; F04C 2240/30; F04C 2240/40; F04C 2240/60; F01C 21/04; F01C 1/0215; F01C 19/125; F01C 17/063
See application file for complete search history.

(56) References Cited

U.S. PATENT DOCUMENTS 2,330,121 A 9/1943 Heintz
2,475,247 A 7/1949 Mikulasek
2,968,157 A 1/1961 Cronan
3,011,694 A 12/1961 Mulhouse et al.
3,262,573 A 7/1966 Schutte
3,470,704 A 10/1969 Kantor
3,600,114 A 8/1971 Miloslav et al.
3,613,368 A 10/1971 Doerner
3,802,809 A 4/1974 Vulliez
3,842,596 A 10/1974 Gray
3,874,827 A 4/1975 Young
3,884,599 A 5/1975 Young et al.
3,924,977 A 12/1975 McCullough
3,986,799 A 10/1976 McCullough
3,986,852 A 10/1976 Doerner et al.
3,994,633 A 11/1976 Shaffer
3,994,635 A 11/1976 McCullough
3,994,636 A 11/1976 McCullough et al.
3,999,400 A 12/1976 Gray
4,065,279 A 12/1977 McCullough
4,069,673 A 1/1978 Lapeyre
4,082,484 A 4/1978 McCullough
4,121,438 A 10/1978 McCullough
4,129,405 A 12/1978 McCullough
4,157,234 A 6/1979 Weaver et al.
4,160,629 A 7/1979 Hidden et al.
4,192,152 A 3/1980 Armstrong et al.
4,199,308 A 4/1980 McCullough
4,216,661 A 8/1980 Tojo et al.
4,259,043 A 3/1981 Hidden et al.
4,300,875 A 11/1981 Fischer et al.
4,340,339 A 7/1982 Hiraga et al.
4,368,802 A * 1/1983 Grabill ..... F16H 57/043 184/6.12
4,382,754 A 5/1983 Shaffer et al.
4,395,205 A 7/1983 McCullough
4,395,885 A 8/1983 Cozby
4,403,494 A 9/1983 McCullough
4,411,605 A 10/1983 Sauls
4,415,317 A 11/1983 Buttersworth
4,416,597 A 11/1983 Eber et al.
4,424,010 A 1/1984 McCullough
4,436,495 A 3/1984 McCullough
4,457,674 A 7/1984 Kawano et al.
4,462,771 A 7/1984 Teegarden
4,463,591 A 8/1984 McCullough
4,472,120 A 9/1984 McCullough
4,475,346 A 10/1984 Young et al.
4,477,238 A 10/1984 Terauchi
4,478,562 A * 10/1984 Schippers ..... B60T 17/02 137/624.13
4,511,091 A 4/1985 Vasco
4,512,066 A 4/1985 McCullough
4,515,539 A 5/1985 Etsuo
4,673,339 A 6/1987 Hayano et al.
4,718,836 A 1/1988 Pottier et al.
4,722,676 A 2/1988 Sugimoto
4,726,100 A 2/1988 Etemad et al.
4,730,375 A 3/1988 Nakamura et al.
4,732,550 A 3/1988 Suzuki et al.
4,802,831 A 2/1989 Suefuji et al.
4,832,586 A 5/1989 Emmenthal et al.
4,867,657 A 9/1989 Kotlarek et al.
4,875,839 A 10/1989 Sakata et al.
4,892,469 A 1/1990 McCullough et al.
4,911,621 A 3/1990 McCullough et al.
4,918,930 A 4/1990 Gaudet et al.
4,927,340 A 5/1990 McCullough
4,990,072 A 2/1991 Guttinger
5,013,226 A 5/1991 Nishida
5,037,280 A 8/1991 Nishida et al.
5,040,956 A 8/1991 Barito et al.
5,044,904 A 9/1991 Richardson, Jr.
5,051,075 A 9/1991 Young
5,051,079 A 9/1991 Richardson, Jr.
5,082,430 A 1/1992 Guttinger
5,099,658 A 3/1992 Utter et al.
5,108,274 A 4/1992 Kakuda et al.
5,127,809 A 7/1992 Amata et al.
5,142,885 A 9/1992 Utter et al.
5,149,255 A 9/1992 Young
5,157,928 A 10/1992 Gaudet et al.
5,160,253 A 11/1992 Okada et al.
5,176,004 A 1/1993 Gaudet
5,214,932 A 6/1993 Abdelmalek
5,222,882 A 6/1993 McCullough
5,224,849 A 7/1993 Forni
5,228,309 A 7/1993 McCullough
5,232,355 A 8/1993 Fujii et al.
5,242,284 A 9/1993 Mitsunaga et al.
5,247,795 A 9/1993 McCullough
RE34,413 E 10/1993 McCullough
5,256,042 A 10/1993 McCullough et al.
5,258,046 A 11/1993 Haga et al.
5,265,431 A 11/1993 Gaudet et al.
5,286,179 A 2/1994 Forni et al.
5,314,316 A 5/1994 Shibamoto et al.
5,328,341 A 7/1994 Forni
5,338,159 A 8/1994 Riffe et al.
5,343,708 A 9/1994 Gaudet et al.
5,354,184 A 10/1994 Forni
5,358,387 A 10/1994 Suzuki et al.
5,397,223 A 3/1995 Spinier et al.
5,417,554 A 5/1995 Kietzman et al.
5,443,368 A 8/1995 Weeks et al.
5,449,279 A 9/1995 Hill et al.
5,450,316 A 9/1995 Gaudet et al.
5,462,419 A 10/1995 Hill et al.
5,466,134 A 11/1995 Shaffer et al.
5,496,161 A 3/1996 Machida et al.
5,609,478 A 3/1997 Utter et al.
5,616,015 A 4/1997 Liepert
5,616,016 A 4/1997 Hill et al.
5,632,612 A 5/1997 Shaffer
5,632,613 A 5/1997 Shin et al.
5,637,942 A 6/1997 Forni
5,640,854 A 6/1997 Fogt et al.
5,720,602 A 2/1998 Hill et al.
5,746,719 A 5/1998 Ferra et al.
5,752,816 A 5/1998 Shaffer
5,759,020 A 6/1998 Shaffer
5,800,140 A 9/1998 Forni
5,803,723 A 9/1998 Suefuji et al.
5,836,752 A 11/1998 Calhoun et al.
5,842,843 A 12/1998 Haga
5,855,473 A 1/1999 Liepert
5,857,844 A 1/1999 Lifson et al.
5,873,711 A 2/1999 Lifson
5,938,419 A 8/1999 Honma et al.
5,951,268 A 9/1999 Pottier et al.
5,961,297 A 10/1999 Haga et al.
5,987,894 A 11/1999 Claudet
6,008,557 A 12/1999 Dornhoefer et al.

(56) References Cited

U.S. PATENT DOCUMENTS 6,022,195 A 2/2000 Gaudet et al.
6,050,792 A 4/2000 Shaffer
6,068,459 A 5/2000 Clarke et al.
6,074,185 A 6/2000 Protos
6,098,048 A 8/2000 Dashefsky et al.
6,129,530 A 10/2000 Shaffer
6,179,590 B1 1/2001 Honma et al.
6,186,755 B1 2/2001 Haga
6,190,145 B1 2/2001 Fujioka et al.
6,193,487 B1 2/2001 Ni
6,213,970 B1 4/2001 Nelson et al.
6,283,737 B1 9/2001 Kazikis et al.
6,318,093 B2 11/2001 Gaudet et al.
6,328,545 B1 12/2001 Kazakis et al.
6,379,134 B2 4/2002 Iizuka
6,434,943 B1 8/2002 Garris
6,439,864 B1 8/2002 Shaffer
6,460,351 B2 10/2002 Gaudet et al.
6,461,113 B1 10/2002 Gaudet et al.
6,464,467 B2 10/2002 Sullivan et al.
6,511,308 B2 1/2003 Shaffer
6,623,445 B1 9/2003 Nelson et al.
6,644,946 B2 11/2003 Nakane et al.
6,663,364 B2 12/2003 Okada et al.
6,712,589 B2 3/2004 Mori et al.
6,736,622 B1 5/2004 Bush et al.
6,755,028 B2 6/2004 Gaudet et al.
6,902,378 B2 6/2005 Gaudet et al.
6,905,320 B2 6/2005 Satoh et al.
6,922,999 B2 8/2005 Kimura et al.
7,111,467 B2 9/2006 Apparao et al.
7,124,585 B2 10/2006 Kim et al.
7,144,383 B2 12/2006 Arnett et al.
7,181,928 B2 2/2007 de Larminat
7,201,568 B2 4/2007 Sakamoto et al.
7,234,310 B2 6/2007 Flynn et al.
7,249,459 B2 7/2007 Hisanaga et al.
7,297,133 B2 11/2007 Nelson et al.
7,306,439 B2 12/2007 Unami et al.
7,314,358 B2 1/2008 Tsuchiya
7,329,108 B2 2/2008 Tscuchiya et al.
7,439,702 B2 10/2008 Smith et al.
7,458,152 B2 12/2008 Sato
7,458,414 B2 12/2008 Simon
7,836,696 B2 11/2010 Uno et al.
7,861,541 B2 1/2011 Dieckmann et al.
7,906,016 B2 3/2011 Weber et al.
7,942,655 B2 5/2011 Shaffer
7,980,078 B2 7/2011 McCutchen et al.
8,007,260 B2 8/2011 Yanagisawa
8,087,260 B2 1/2012 Ogata et al.
8,186,980 B2 5/2012 Komai et al.
8,328,544 B2 12/2012 Iwano et al.
8,484,974 B1 7/2013 Monson et al.
8,523,544 B2 9/2013 Shaffer
8,668,479 B2 3/2014 Shaffer
8,674,525 B2 3/2014 Van Den Bossche et al.
8,858,203 B2 10/2014 Kanizumi et al.
9,022,758 B2 5/2015 Roof et al.
9,028,230 B2 5/2015 Shaffer
9,074,598 B2 7/2015 Shaffer et al.
9,115,719 B2 8/2015 Sadakata et al.
9,657,733 B2 5/2017 Chadwick et al.
9,784,139 B2 10/2017 Shaffer et al.
9,885,358 B2 2/2018 Shaffer
10,221,852 B2 3/2019 Shaffer et al.
10,400,771 B2 9/2019 Valdez et al.
10,890,187 B2 * 1/2021 Fukuhara ..... F04C 29/025
2001/0012485 A1 8/2001 Gaudet et al.
2001/0038800 A1 11/2001 Kumura et al.
2001/0043878 A1 11/2001 Sullivan et al.
2002/0011332 A1 1/2002 Oh et al.
2002/0039534 A1 4/2002 Moroi et al.
2002/0071779 A1 6/2002 Moroi et al.
2002/0094277 A1 7/2002 Gaudet et al.
2002/0104320 A1 8/2002 Gaudet et al.
2003/0017070 A1 1/2003 Moroi et al.
2003/0051487 A1 3/2003 Gaudet et al.
2003/0138339 A1 7/2003 Scancarello
2003/0223898 A1 12/2003 Fujioka et al.
2004/0020206 A1 2/2004 Sullivan et al.
2004/0184940 A1 9/2004 Nakane et al.
2004/0194477 A1 10/2004 Gaudet et al.
2004/0241030 A1 12/2004 Matsushima
2004/0255591 A1 12/2004 Hisanga et al.
2005/0025651 A1 2/2005 Sowa et al.
2005/0031469 A1 2/2005 Yanagisawa et al.
2005/0081536 A1 4/2005 Gaudet et al.
2005/0169788 A1 8/2005 Komai et al.
2005/0196284 A1 9/2005 Gaudet et al.
2005/0220649 A1 10/2005 Sato
2006/0016184 A1 1/2006 Simon
2006/0045760 A1 3/2006 Haller et al.
2006/0045783 A1 3/2006 Yanagisawa et al.
2006/0130495 A1 6/2006 Dieckmann et al.
2007/0071626 A1 3/2007 Tsuchiya et al.
2007/0098511 A1 * 5/2007 Kikkawa ..... B23B 31/265 409/231
2007/0104602 A1 5/2007 Ishikawa et al.
2007/0108934 A1 5/2007 Smith et al.
2007/0172373 A1 7/2007 Ni
2007/0231174 A1 10/2007 Ishizuki
2007/0269327 A1 11/2007 Qian
2008/0159888 A1 7/2008 Nakayama et al.
2008/0193311 A1 8/2008 Helies
2008/0206083 A1 8/2008 Suefuji et al.
2009/0148327 A1 6/2009 Carter et al.
2009/0246055 A1 10/2009 Stehouwer et al.
2010/0044320 A1 2/2010 Weber et al.
2010/0111740 A1 5/2010 Ni
2010/0254835 A1 10/2010 Kane et al.
2010/0287954 A1 11/2010 Harman et al.
2011/0129362 A1 6/2011 Kameya et al.
2012/0134862 A1 5/2012 Hockliffe et al.
2012/0240847 A1 9/2012 Neufelder et al.
2013/0149179 A1 6/2013 Sato et al.
2013/0207396 A1 8/2013 Tsuboi
2013/0232975 A1 9/2013 Shaffer et al.
2014/0023540 A1 1/2014 Heidecker et al.
2014/0260364 A1 9/2014 Litch
2016/0327042 A1 * 11/2016 Shaffer ..... F04C 25/02
2017/0045046 A1 2/2017 Afshari
2017/0051741 A1 * 2/2017 Shaffer ..... F01C 1/0261
2017/0067469 A1 3/2017 Malvasi et al.
2017/0074265 A1 3/2017 Asami et al.
2017/0268514 A1 9/2017 Shaffer
2017/0284284 A1 10/2017 Takamiya
2017/0306956 A1 10/2017 Monet
2017/0321699 A1 11/2017 Kawano et al.
2017/0362962 A1 12/2017 Shaffer et al.
2018/0163726 A1 * 6/2018 Shaffer ..... F04C 29/04
2018/0216498 A1 8/2018 Shaffer et al.
2019/0211824 A1 7/2019 Shaffer et al.
2019/0293070 A1 9/2019 Crum et al.
2019/0353162 A1 11/2019 Ishii et al.
2020/0040892 A1 2/2020 Dieckmann et al.

FOREIGN PATENT DOCUMENTS

CN 104235018 12/2014
CN 104632636 5/2015
CN 105402134 3/2016
DE 460936 6/1928
DE 19957425 8/2000
EP 0513824 11/1992
EP 0780576 6/1997
EP 1464838 10/2004
EP 3239526 11/2017
GB 0513827 10/1939
GB 2002455 2/1979
GB 1575684 9/1980
JP S56-019369 2/1981
JP S57-171002 10/1982
JP S60-135691 7/1985

(56) References Cited

FOREIGN PATENT DOCUMENTS

| | | |
|---|---|---|
| JP | S63-173870 | 7/1988 |
| JP | H02-275083 | 11/1990 |
| JP | H03-185287 | 8/1991 |
| JP | H05-157076 | 6/1993 |
| JP | H07-109981 | 4/1995 |
| JP | H07-324688 | 12/1995 |
| JP | H08-261182 | 10/1996 |
| JP | 2000-213475 | 8/2000 |
| JP | 2002-13493 | 1/2002 |
| JP | 2002-227779 | 8/2002 |
| JP | 2003-343459 | 12/2003 |
| JP | 2011-012629 | 1/2011 |
| WO | WO 2004/008829 | 1/2004 |
| WO | WO 2009/050126 | 4/2009 |
| WO | WO 2013/121900 | 8/2013 |
| WO | WO 2015/164453 | 10/2015 |
| WO | WO 2017/089745 | 6/2017 |

OTHER PUBLICATIONS

Official Action for U.S. Appl. No. 16/291,984, dated Oct. 26, 2020 12 pages.
"Digital Scroll Compressor Technology," Wikipedia, 2010, 3 pages [retrieved online from: en.wikipedia.org/wiki/Digital_Scroll_Compressor_Technology].
"Heat Pump and Refrigeration Cycle," Wikipedia, last updated May 10, 2013, 4 pages [retrieved online from: en.wikipedia.org/wiki/Heat_pump_and_refrigeration_cycle].
"Involute," Wikipedia, last modified Jun. 2, 2012, 5 pages [retrieved online from: en.wikipedia.org/wiki/Involute].
"Oldham Coupler," Wikipedia, last modified, Feb. 9, 2010, 2 pages [retrieved online from: en.wikipedia.org/wiki/Oldham_coupler].
"Organic Rankine Cycle," Wikipedia, last modified May 19, 2013, 4 pages [retrieved online from: en.wikipedia.org/wiki/Organic_Rankine_Cycle].
"Rankine Cycle," Wikipedia, last modified Apr. 29, 2013, 4 pages [retrieved online from: en.wikipedia.org/wiki/Rankine_cycle].
"Scroll Compressor," Wikipedia, last modified Apr. 24, 2013, 3 pages [retrieved online from: en.wikipedia.org/wiki/Scroll_compressor].
"Thrust Bearing," Wikipedia, last modified Dec. 19, 2012, 2 pages [retrieved online from: en.wikipedia.org/wiki/Thrust_bearing].
International Search Report and Written Opinion for Interiantional (PCT) Patent Application No. PCT/US2018/064427, dated Feb. 5, 2019 14 pages.
International Search Report for International (PCT) Patent Application No. PCT/US01/43523, dated Jun. 5, 2002 1 page.
International Search Report for International (PCT) Patent Application No. PCT/US01/50377, dated May 13, 2002 1 page.
Partial Search Report for European Patent Application No. 13003663.5, dated May 28, 2014 5 pages.
Extended Search Report for European Patent Application No. 13003663.5, dated Sep. 3, 2014 11 pages.
International Search Report and Written Opinion for International (PCT) Patent Application No. PCT/US14/00076, dated Dec. 17, 2014 6 pages.
International Search Report and Written Opinion for International (PCT) Patent Application No. PCT/US18/00118, dated Sep. 24, 2018 19 pages.
Official Action for U.S. Appl. No. 11/703,585, dated Dec. 18, 2009 7 pages.
Official Action for U.S. Appl. No. 11/703,585, dated Jul. 20, 2010 7 pages.
Notice of Allowance for U.S. Appl. No. 11/703,585, dated Feb. 4, 2011 4 pages.
Official Action for U.S. Appl. No. 12/930,140, dated Jan. 14, 2013 22 pages.
Official Action for U.S. Appl. No. 12/930,140, dated Jun. 13, 2013 21 pages.
Notice of Allowance for U.S. Appl. No. 12/930,140, dated Oct. 24, 2013 12 pages.
Official Action for U.S. Appl. No. 13/066,261, dated Feb. 11, 2013 5 pages Restriction Requirement.
Notice of Allowance for U.S. Appl. No. 13/066,261, dated Apr. 4, 2013 13 pages.
Official Action for U.S. Appl. No. 13/987,486, dated Dec. 16, 2013 5 pages Restriction Requirement.
Official Action for U.S. Appl. No. 13/987,486, dated Apr. 23, 2014 13 pages.
Official Action for U.S. Appl. No. 13/987,486, dated Oct. 20, 2014 11 pages.
Notice of Allowance for U.S. Appl. No. 13/987,486, dated Jan. 5, 2015 5 pages.
Corrected Notice of Allowance for U.S. Appl. No. 13/987,486, dated Feb. 20, 2015 8 pages.
Official Action for U.S. Appl. No. 14/544,874, dated Dec. 23, 2016 5 pages Restriction Requirement.
Official Action for U.S. Appl. No. 14/544,874, dated Jan. 26, 2017 9 pages.
Official Action for U.S. Appl. No. 14/544,874, dated Jul. 21, 2017 6 pages.
Notice of Allowance for U.S. Appl. No. 14/544,874, dated Sep. 28, 2017 5 pages.
Official Action for U.S. Appl. No. 15/330,223, dated Nov. 15, 2017 6 pages Restriction Requirement.
Official Action for U.S. Appl. No. 15/330,223, dated Feb. 7, 2018 10 pages.
Official Action for U.S. Appl. No. 15/330,223, dated Aug. 7, 2018 10 pages.
Official Action for U.S. Appl. No. 15/330,223, dated Jan. 11, 2019 14 pages.
Official Action for U.S. Appl. No. 14/507,779, dated Apr. 8, 2014 17 pages.
Official Action for U.S. Appl. No. 13/507,779, dated Dec. 1, 2014 17 pages.
Notice of Allowance for U.S. Appl. No. 14/507,779, dated Mar. 6, 2015 8 pages.
Official Action for U.S. Appl. No. 13/986,349, dated Jan. 21, 2015 25 pages.
Official Action for U.S. Appl. No. 13/986,349, dated Aug. 12, 2015 20 pages.
Official Action for U.S. Appl. No. 14/756,594, dated Mar. 29, 2017 13 pages.
Notice of Allowance for U.S. Appl. No. 14/756,594, dated Jun. 5, 2017 8 pages.
Official Action for U.S. Appl. No. 15/731,929, dated Jan. 31, 2019 11 pages.
Official Action for U.S. Appl. No. 15/731,929, dated Jun. 4, 2019 10 pages.
Notice of Allowance for U.S. Appl. No. 15/731,929, dated Aug. 14, 2019 9 pages.
Official Action for U.S. Appl. No. 14/999,427, dated Oct. 5, 2017 6 pages Restriction Requirement.
Official Action for U.S. Appl. No. 14/999,427, dated Feb. 9, 2018 9 pages.
Notice of Allowance for U.S. Appl. No. 14/999,427, dated Sep. 21, 2018 18 pages.
Official Action for U.S. Appl. No. 15/731,324, dated Feb. 7, 2019 15 pages.
Notice of Allowance for U.S. Appl. No. 15/731,324, dated Aug. 2, 2019 11 pages.
Official Action for U.S. Appl. No. 15/373,979, dated Jan. 29, 2019 12 pages.
Notice of Allowance for U.S. Appl. No. 15/373,979, dated Apr. 26, 2019 9 pages.
"Operating Manual: OM WGZC-2 Water-Cooled Scroll Compressor Chillers," McQuay International, 2010, 102 pages.
"R410A // Hermetic Scroll Compressors," Bitzer, 2016, 12 pages.
"Refrigeration Technologies: scroll-compressor chillers," Misto, last modified Jan. 2013, 7 pages.
Notice of Allowance for U.S. Appl. No. 15/330,223, dated Jan. 23, 2020 10 pages.

(56) References Cited

OTHER PUBLICATIONS

Official Action for U.S. Appl. No. 15/932,150, dated Nov. 25, 2019 26 pages.
Official Action for U.S. Appl. No. 15/932,150, dated Mar. 5, 2020 19 pages.
Official Action for U.S. Appl. No. 15/732,593, dated Nov. 14, 2019 7 pages Restriction Requirement.
Official Action for U.S. Appl. No. 15/732,593, dated Feb. 19, 2020 13 pages.
International Preliminary Report on Patentability for International (PCT) Patent Application No. PCT/US18/00118, dated Jun. 11, 2020 13 pages.
Notice of Allowance for U.S. Appl. No. 15/932,150, dated May 14, 2020 9 pages.
Extended European Search Report for European Patent Application No. 18883031.9, dated May 3, 2021 6 pages.
Official Action with English Translation for Japan Patent Application No. 2020-548856, dated Jun. 29, 2021 10 pages.
Notice of Allowance for U.S. Appl. No. 16/275,943, dated Mar. 22, 2021 12 pages.
Official Action for U.S. Appl. No. 16/514,639, dated Apr. 12, 2021 6 pages Restriction Requirement.
Official Action for U.S. Appl. No. 16/514,639, dated Jul. 9, 2021 11 pages.
Notice of Allowance for U.S. Appl. No. 16/291,984, dated Feb. 26, 2021 13 pages.
Official Action for U.S. Appl. No. 16/213,111, dated May 4, 2021 25 pages.
Official Action for U.S. Appl. No. 16/275,943, dated Oct. 9, 2020 15 pages.
Official Action for U.S. Appl. No. 16/213,111, dated Sep. 30, 2020 22 pages.
Notice of Allowance for U.S. Appl. No. 15/732,593, dated Aug. 13, 2020 9 pages.
Official Action with English Translation for Japan Patent Application No. 2020-561761, dated Sep. 21, 2021 6 pages.
Official Action with English Translation for China Patent Application No. 201880077598.0, dated Aug. 12, 2021 13 pages.
Notice of Allowance with English Translation for Japan Patent Application No. 2020-548856, dated Nov. 2, 2021 5 pages.
Official Action for U.S. Appl. No. 16/514,639, dated Nov. 9, 2021 12 pages.
Official Action (English Translation) for China Patent Application No. 201980029887.8, dated Dec. 3, 2021 10 pages.
Extended European Search Report for European Patent Application No. 18917539.1, dated Jan. 4, 2022 7 pages.
Decision to Grant for Japan Patent Application No. 2020-561761, dated Feb. 15, 2022 6 pages.
Notice of Allowance with English Translation for China Patent Application No. 201880077598.0, dated Feb. 18, 2022 6 pages.
Official Action for U.S. Appl. No. 16/514,639, dated Mar. 4, 2022 26 pages.
Official Action for U.S. Appl. No. 16/514,639, dated Jun. 23, 2022 26 pages.
Official Action for U.S. Appl. No. 16/213,111, dated Dec. 8, 2021 23 pages.
Notice of Allowance for U.S. Appl. No. 16/213,111, dated Apr. 26, 2022 10 pages.
Official Action for U.S. Appl. No. 16/950,690, dated Jan. 6, 2022 7 pages Restriction Requirement.
Official Action for U.S. Appl. No. 16/950,690, dated Mar. 17, 2022 16 pages.
Official Action for U.S. Appl. No. 16/912,537, dated Nov. 19, 2021 24 pages.
Notice of Allowance for U.S. Appl. No. 16/912,537, dated May 25, 2022 8 pages.
Notice of Allowance with English Translation for China Patent Application No. 201980029887.8, dated Jun. 28, 2022 6 pages.
Official Action for U.S. Appl. No. 17/538,999, dated Jul. 20, 2022 27 pages.

* cited by examiner

ORBITING SCROLL DEVICE LUBRICATION

CROSS-REFERENCE TO RELATED APPLICATIONS

This application claims the benefit of U.S. Provisional Patent Application No. 62/699,834, filed Jul. 18, 2018 and entitled "Orbiting Scroll Expander Lubrication," the entirety of which is hereby incorporated by reference herein for all purposes.

GOVERNMENT LICENSE RIGHTS

This invention was made with government support under DE-AR0000648 awarded by the U.S. Department of Energy. The government has certain rights in the invention.

FIELD

The present disclosure relates to scroll devices such as compressors, expanders, or vacuum pumps, and more particularly to lubricated scroll devices.

BACKGROUND

Large scroll expander devices require large bearings able to withstand axial and radial loads during operation. Oil must be supplied at a sufficient oil flow rate to cool and lubricate these bearings. Traditionally, an oil mist exiting the scroll is used to lubricate all internal bearings. This is known as passive bearing lubrication.

Additionally, large scroll expander devices are often made of aluminum to reduce weight and improve heat transfer. During high temperature operation, thermal expansion causes bearing bores to increase in size.

SUMMARY

Passive bearing lubrication is highly unpredictable, uneven, and dependent on both expander speed and load. Bearings of different size require specific amounts of oil to maintain trouble-free operation.

Scroll expander devices have also been lubricated with grease instead of oil. However, grease compatibility with refrigerants is often poor. Grease lubricated bearings are not actively cooled, and require a re-grease interval that increases expander downtime. Re-greasing can be costly and time consuming.

With respect to scroll expander devices made of aluminum, during high temperature operation, thermal expansion causes bearing bores to increase in size. This thermal expansion is non-uniform between the aluminum scroll and steel bearings. The non-uniform thermal expansion may cause bearing outer races to spin within the bore.

Moreover, pressing steel bearing sleeves into scroll components causes significant warping. This warping can cause premature scroll failure.

The present disclosure describes systems and methods for improved bearing lubrication and retention within scroll devices, resulting in increased scroll device reliability.

The term "scroll device" as used herein refers to scroll compressors, scroll vacuum pumps, and similar mechanical devices. The term "scroll device" as used herein also encompasses scroll expanders, with the understanding that scroll expanders absorb heat rather than generating heat in some aspects, such that the various aspects and elements described herein for cooling scroll devices other than scroll expanders may be used for heating scroll expanders (e.g., by circulating warm air).

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. The drawings are not to be construed as limiting the disclosure to only the illustrated and described examples.

DETAILED DESCRIPTION

Before any embodiments of the disclosure are explained in detail, it is to be understood that the disclosure is not limited in its application to the details of construction and the arrangement of components set forth in the following description or illustrated in the figures. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

Aspects of the present disclosure improve bearing lubrication and retention with scroll devices and increase scroll device reliability.

With reference first to FIGS. 1-4, large scroll devices are susceptible to bearing oil starvation, which dramatically reduces bearing life and causes premature scroll failure. To address these issues, a scroll device 100 is configured to direct an oil/refrigerant mixture directly into the bearings thereof, as will now be described in more detail.

Figure 1:
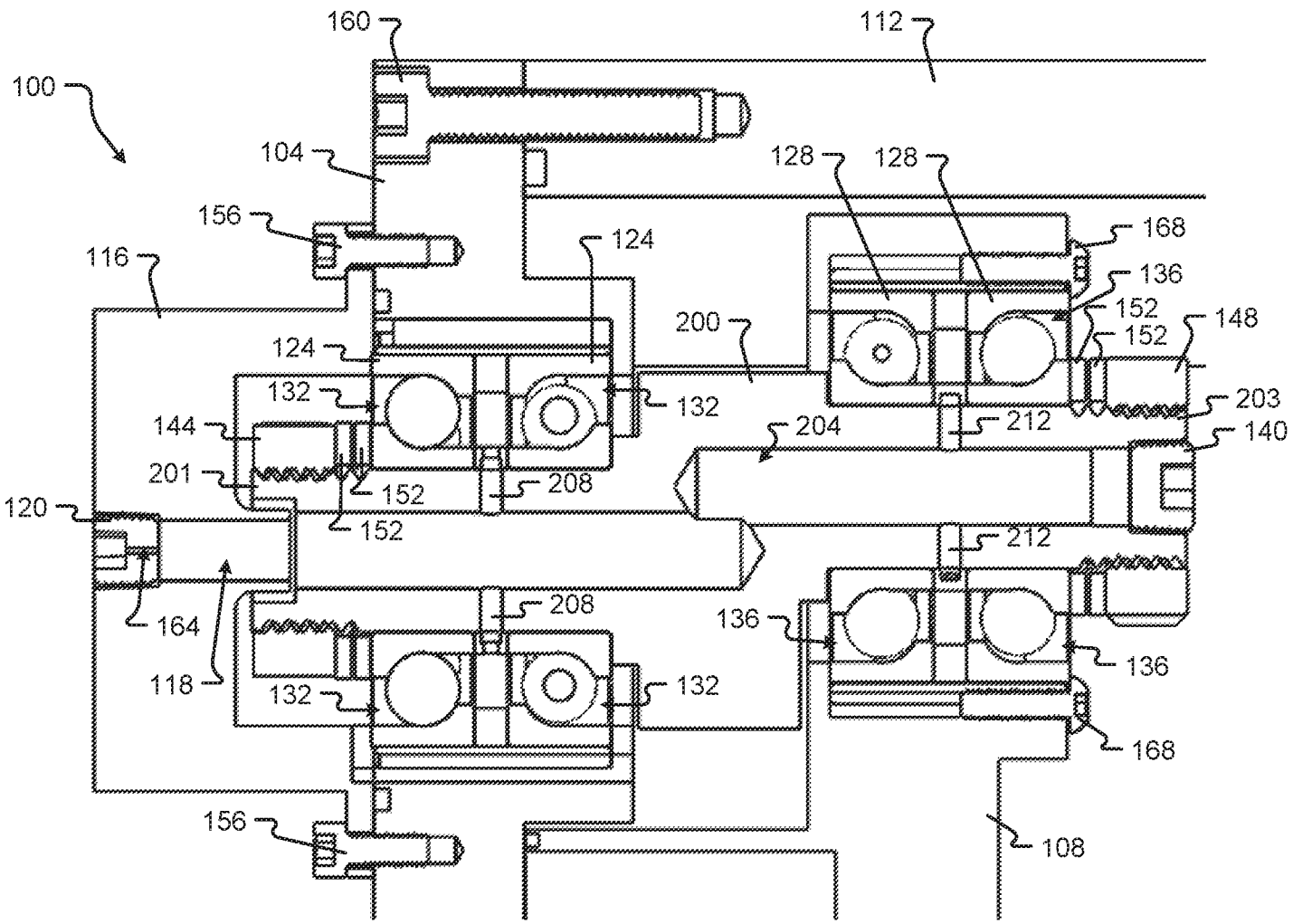
FIG. 1 is a side cross-sectional view of a scroll expander according at least some embodiments of the present disclosure.
Figure 2:
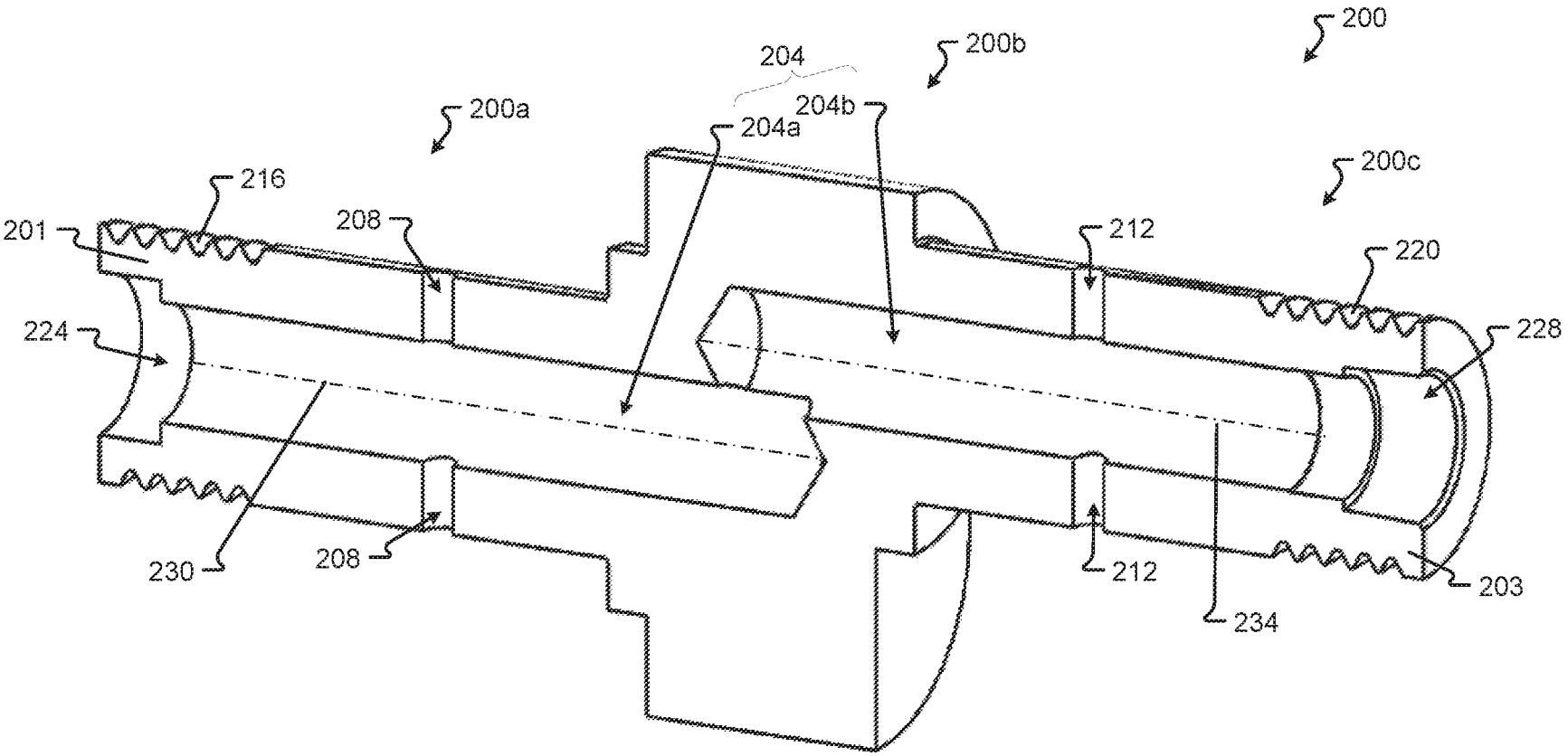
FIG. 2 is a perspective cross-sectional view of an idler shaft according to at least some embodiments of the present disclosure.
Figure 3:
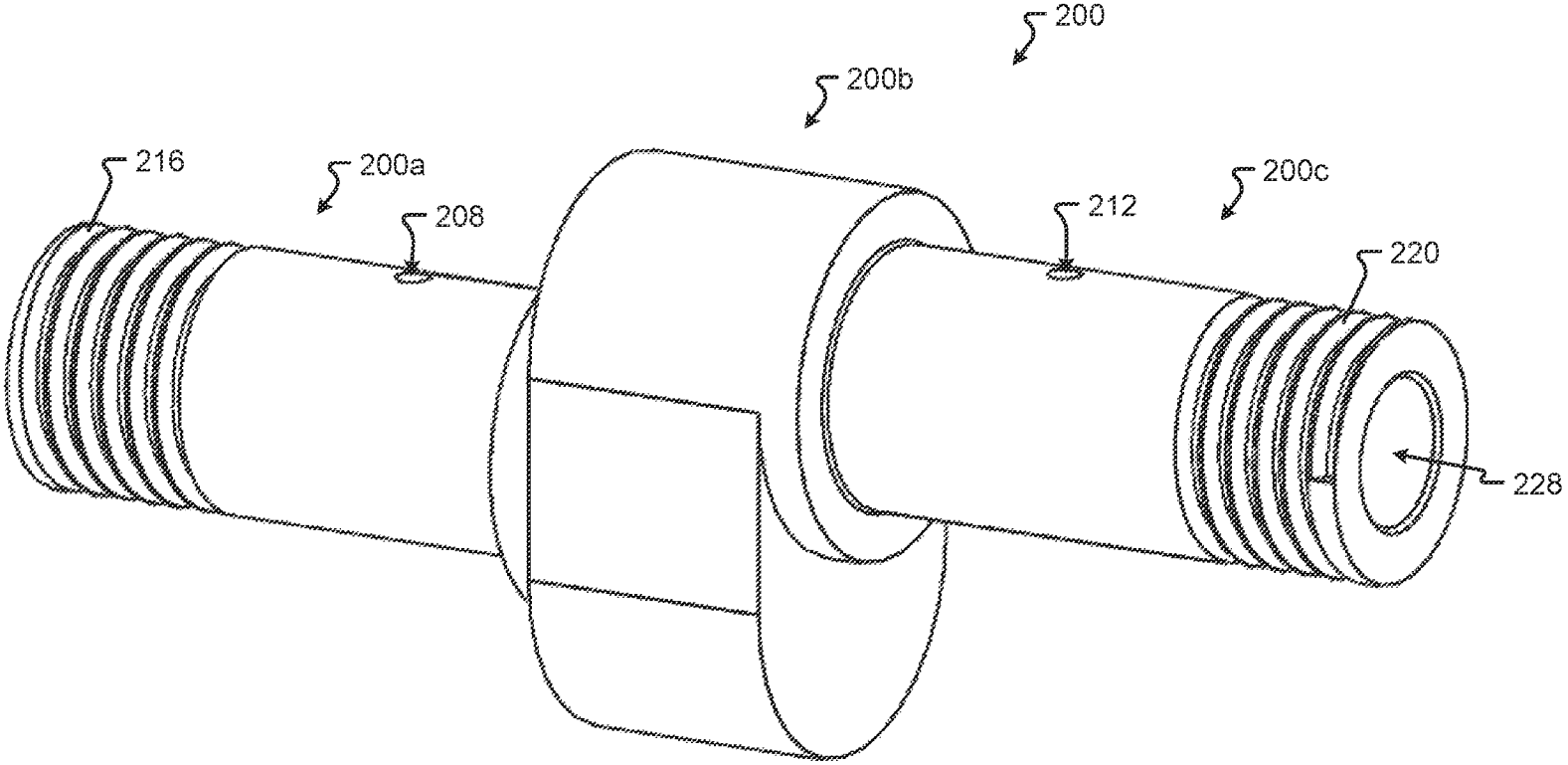
FIG. 3 is a perspective view of an idler shaft according to at least some embodiments of the present disclosure.
Figure 4:
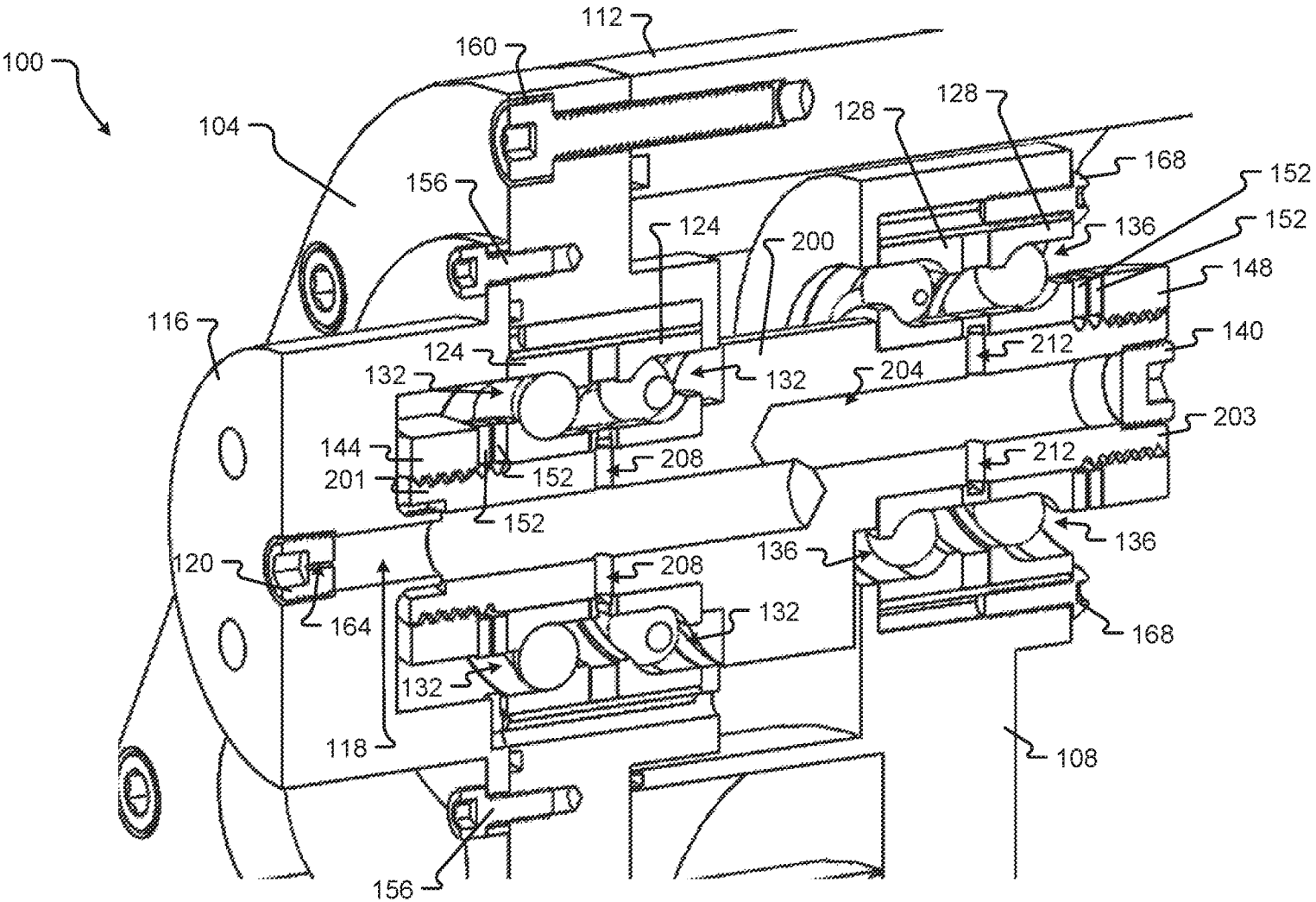
FIG. 4 is a perspective cross-sectional view of a scroll expander according to at least some embodiments of the present disclosure.

The scroll device 100 comprises a fixed scroll 104, an orbiting scroll 108, a housing 112, and an idler shaft cap 116. The fixed scroll 104 is secured to the housing via one or more fasteners 160, while the orbiting scroll 108 is movably secured to the fixed scroll 104 via a plurality of idler shaft assemblies, only one of which is shown in FIGS. 1 and 4 but each of which may be identical or substantially similar. In each idler shaft assembly, the idler shaft cap 116 defines a central passageway 118 into which an orifice plug 120 or other lubricant metering plug is inserted. (In some embodiments, the orifice plug 120 may be positioned within the hollow core 204 proximate the end 201 of the idler shaft 200, or may be positioned along another flow path that feeds into the hollow core 204 but that is not contained within an idler shaft cap 116.) An orifice 164 extends through the orifice plug 120. Each idler shaft assembly of the scroll device 100 also comprises two bearings 124 supporting one arm 200*a* of an idler shaft 200, and two bearings 128 supporting an opposite arm 200*c* of the idler shaft 200. A central portion 200*b* of the idler shaft 200 connects the arm 200*a* to the arm 200*c*. The bearings 124 are configured with open sides 132 such that liquid (e.g., an oil/refrigerant mixture) can pass therethrough. The bearings 128 are configured with open sides 136 for the same purpose.

The bearings 124 are secured within the fixed scroll 104 in part by a nut 144 that threadably engages the exterior threads 216 on the end 201 of the idler shaft 200, which end 201 protrudes from and is adjacent to the fixed scroll 104 and the outer bearing 124. The nut 144 comprises internal threads, which engage the exterior threads 216 on the end 201 of the idler shaft 200. Two washers or gaskets 152 are positioned on the arm 200*a* in between the nut 144 and the outer bearing 124. The washers or gaskets 152 fill a gap between the nut 144 and the outer bearing 124, and thus transfer force axially from the nut 144 to the outer bearing 124 to hold the outer bearing 124 in position within the fixed scroll 104.

The bearings 124 are also secured within the fixed scroll 104 in part by the idler shaft cap 116, a portion of which presses against the outer bearing 124 when the idler shaft cap 116 is installed on the fixed scroll 104. The idler shaft cap 116 is in turn secured to the fixed scroll 104 via a plurality of fasteners 156. The fasteners 156 may be threaded fasteners as shown, or the fasteners 156 may be any other mechanical fastener suitable for securing the idler cap 116 to the fixed scroll 104.

Similarly, the bearings 128 are secured within the orbiting scroll 108 in part by a nut 148 that threadably engages the exterior threads 220 on the end 203 of the idler shaft 200, which end 203 protrudes from and is adjacent to the orbiting scroll 108 and the outer bearing 128. The nut 148 comprises internal threads, which engage the threads 220 on the end 203 of the idler shaft 200. Two washers or gaskets 152 are positioned on the arm 200*c* in between the nut 148 and the outer bearing 128. These washers or gaskets 152 fill a gap between the nut 148 and the outer bearing 128, and thus transfer force axially from the nut 148 to the outer bearing 128 to hold the outer bearing 128 in position within the orbiting scroll 108.

The bearings 128 are also secured within the orbiting scroll 108 in part by a plurality of fasteners 168. The fasteners 168 are provided with a head having a radius larger than a shaft thereof, such that the head overlaps a portion of the outer bearing 128 and thus helps to secure the outer bearing 128 within the orbiting scroll 108. The fasteners 168 may be threaded fasteners as shown, or the fasteners 168 may be any other mechanical fasteners suitable for securing (or helping to secure) the bearings 128 to the orbiting scroll 108.

The arms 200*a* and 200*c* of the idler shaft 200 are offset or eccentric, which enables the idler shaft 200 to guide the orbiting scroll 108 in an orbiting motion relative to the fixed scroll 104. The arm 200*a* may have an axis 230, and the arm 200*c* may have an axis 234 that is parallel to but offset from the axis 230. Embodiments of the present disclosure may comprise arms 200*a* and 200*c* that are more or less offset or eccentric relative to each other and to the central portion 200*b* than the arms 200*a* and 200*c* of the idler shaft 200 illustrated in FIGS. 1-4. In other embodiments, the arms 200*a* and 200*c* may be concentric (although an idler shaft 200 having concentric arms 200*a* and 200*c* would not likely be used in connection with an orbiting scroll device). In other words, the purpose and function of the present disclosure are not limited for use in and/or with an eccentric idler shaft, although described herein in connection with an eccentric idler shaft.

The idler shaft 200 comprises a hollow core 204. The hollow core 204 comprises a first portion 204*a* extending through the arm 200*a* of the idler shaft 200, and a second portion 204*b* extending through the arm 200*c* of the idler shaft 200. A first set of channels 208 extends radially from the hollow core first portion 204*a* through the arm 200*a* (e.g., positioned so as to be approximately in between the bearings 124), and a second set of channels 212 extends radially from the hollow core second portion 204*b* through the arm 200*c* (e.g., positioned so as to be approximately in between the bearings 128). The channels 208 and 212 enable fluid communication between the hollow core 204 and an exterior of the idler shaft 200. At the end 201 of the idler shaft 200, the hollow core first portion 204*a* comprises a receptacle portion 224 with an expanded radius. The receptacle portion 224 is configured to receive a portion of the idler shaft cap 116 defining the central passageway 118, such that the hollow core 204 and the central passageway 118 form a substantially continuous conduit. At the end 203 of the idler shaft 200, the hollow core second portion 204*b* comprises a plug portion 228 with an expanded radius. The plug portion 228 is configured to receive a plug 140 that prevents fluid flow out of the hollow core second portion 204*b* at the end 203. The plug 140 may be made, for example, from rubber, plastic, or any other material suitable for sealing the hollow core second portion 204*b* to fluid flow at the end 203. The plug 140 may comprise a plurality of ridges or flanges around the circumference thereof that are configured to press against the wall of the plug portion 228 and thus enhance the sealing ability of the plug 140. The plug 140 may be adapted to be secured within the plug portion 228 by a press fit or a friction fit. In some embodiments, the plug portion 228 may comprise interior threads, and the plug 140 may comprise corresponding exterior threads to enable the plug 140 to be threadingly engaged to the plug portion 228.

When the scroll device 100 is in operation, a lubricant such as oil or an oil/refrigerant mixture may be carried to the orifice plug 120 by a hose or other fluid conduit, an end of which may be received by a receptacle portion of the orifice plug. The hose or other fluid conduit may be secured to the orifice plug 120 (whether removably or not) by a friction fit or otherwise. Upon reaching the scroll device 100, the lubricant flows through a lubrication channel that may include one or more of the orifice 164 of the orifice plug 120; the central passageway 118 of the idler shaft cap 116, the hollow core 204 of the idler shaft 200; the channels 208 and/or 212; the open sides 132 and/or 136 of the bearings 124 and 128, respectively; and one or more flow paths through the housing 112. In one embodiment, for example, the lubricant is metered by the orifice 164 of the orifice plug 120 into the central passageway 118, which guides the lubricant into the hollow core 204. Due to the spinning of the idler shaft 200, the lubricant flows along the walls of the hollow core 204 and through the channels 208 and 212, which deposit the lubricant in between the bearings 124 and the bearings 128, respectively. After exiting the channels 208 and 212, the lubricant flows through the open sides 132 of the bearings 124 and through the open sides 136 of the bearings 128, thus lubricating the bearings. Lubricant that has passed through the bearings 124 and 128 collects within the housing 112, and may be filtered and recirculated to minimize waste. In some embodiments, the housing 112 may have one or more lubricant return paths machined or otherwise provided therein to aid in the collection of lubricant therefrom, whether for filtration and recirculation or disposal.

In some embodiments, the orifice plug 120 may be easily removed and replaced to change the flow rate of lubricant into the idler shaft 200. Within the orifice plug 120, a larger metered orifice 164 allows more lubricant to reach the bearings in a given time period, while a smaller metered orifice 164 reduces the amount of lubricant that reaches the bearings in a given time period. As a result, the orifice plug 120 may be sized as desired to ensure that a proper amount of lubricant reaches the bearings 124, 128 of a given scroll device 100. Moreover, use of the orifice plug 120 beneficially ensures a constant flow rate of lubricant through the idler shaft 200 and into the bearing 124 and 128, thus avoiding problems resulting from an inconsistent lubricant flow rate.

The orifice plug 120 may be made of rubber, plastic, metal, or any other material suitable for sealing around the outer edge of the receptacle portion 224 while metering lubricant through an orifice 164 thereof. In some embodiments, the receptacle portion 224 may comprise internal threads, and the orifice plug 120 may comprise external threads, thus allowing the orifice plug to threadably engage the receptacle portion 224. In other embodiments, the orifice plug 120 may be configured to engage the receptacle portion 224 with a friction fit. The orifice plug 120 may comprise a plurality of ridges or flanges around the circumference thereof that are configured to press against the wall of the receptacle portion 224 and thus enhance the sealing ability of the orifice plug 120 relative to the receptacle portion 224.

Although the orifice plug 120 is described above as being removable, in other embodiments the orifice plug 120 may be permanently secured within the receptacle portion 224, whether by welding, pressing, chemical bonding, or otherwise.

The channels 208 and 212 illustrated in FIGS. 1-4 are configured to channel lubricant from the hollow core 204 to a position in between pairs of bearings 124 and 128, but in other embodiments the channels 208 and 212 may be configured differently. For example, in scroll devices using idler shaft assemblies that comprise only one bearing 124 and/or only one bearing 128, the channels 208 and/or 212 may be configured to deposit lubricant directly into the one bearing 124 and/or 128. In some embodiments, the channels 208 and/or 212 may be configured to deposit lubricant on a side of a bearing 124 and/or 128 that is not adjacent to another bearing 124 and/or 128. In such embodiments, a flow channel for the lubricant may be provided that causes the lubricant to flow through a first bearing 124 and/or 128 and then through a second one or more bearings 124 and/or 128 before the lubricant is collected within the housing 112 or discarded.

Also in some embodiments, the idler shaft 200 may comprise only one channel 208 and/or only one channel 212, or may comprise more than two channels 208 and/or more than two channels 212. In embodiments having a plurality of channels 208 and/or a plurality of channels 212, the plurality of channels 208 and/or the plurality of channels 212 may be angularly spaced at equal intervals, or may be angularly spaced at uneven intervals. Further, all of the channels 208 need not be positioned at the same axial location of the arm 200*a*, and all of the channels 212 need not be positioned at the same axial location of the arm 200*c*. In other words, the arm 200*a* may comprise a plurality of channels 208, with one or more channels 208 axially positioned, for example, to deliver lubricant to a first bearing 124, and one or more channels 208 axially positioned, for example, at a different location to deliver lubricant to a second bearing 124. Similarly, the arm 200*c* may comprise a plurality of channels 212, with one or more channels 212 axially positioned, for example, to deliver lubricant to a first bearing 128, and one or more channels 212 axially positioned, for example, at a different location to deliver lubricant to a second bearing 128.

Although the channels 208 and 212 are shown extending in the radial direction from the hollow core 204 (e.g., perpendicular to an axis of the hollow core 204), in some embodiments the channels 208 and/or the channels 212 may extend from the hollow 204 at an angle (e.g., between 0 degrees and 90 degrees relative to an axis of the hollow core 204). Also in some embodiments, one or more of the channels 208 and 212 may be curved (e.g., have a curved centerline) and/or may have a non-constant cross-section. An inner surface of the channels 208 and/or 212 may comprise ridges or grooves, which may be straight, circular, or helical.

Figure 5:
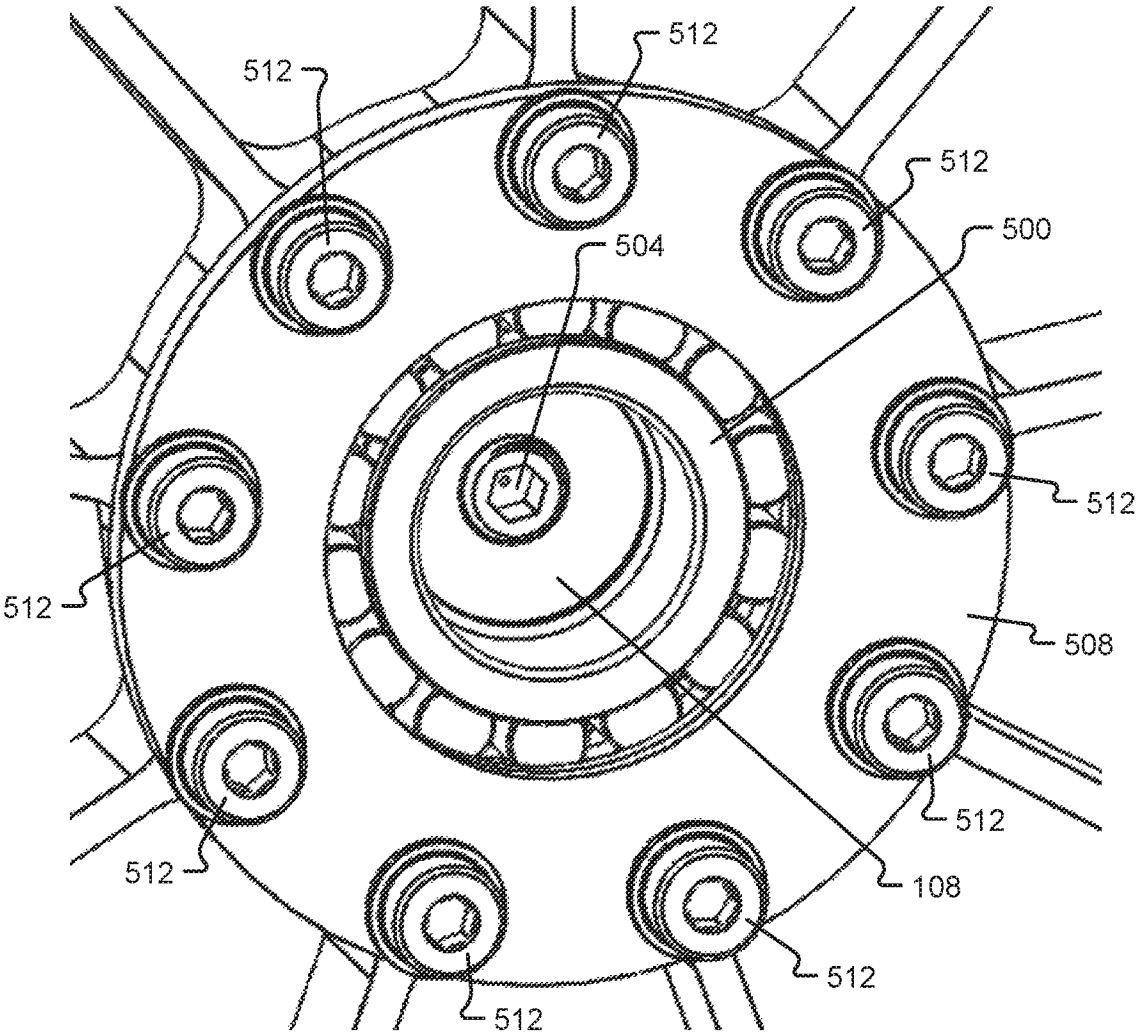
FIG. 5 is a close-up perspective view of the crankshaft interface of an orbiting scroll according to at least some embodiments of the present disclosure.
Figure 6:
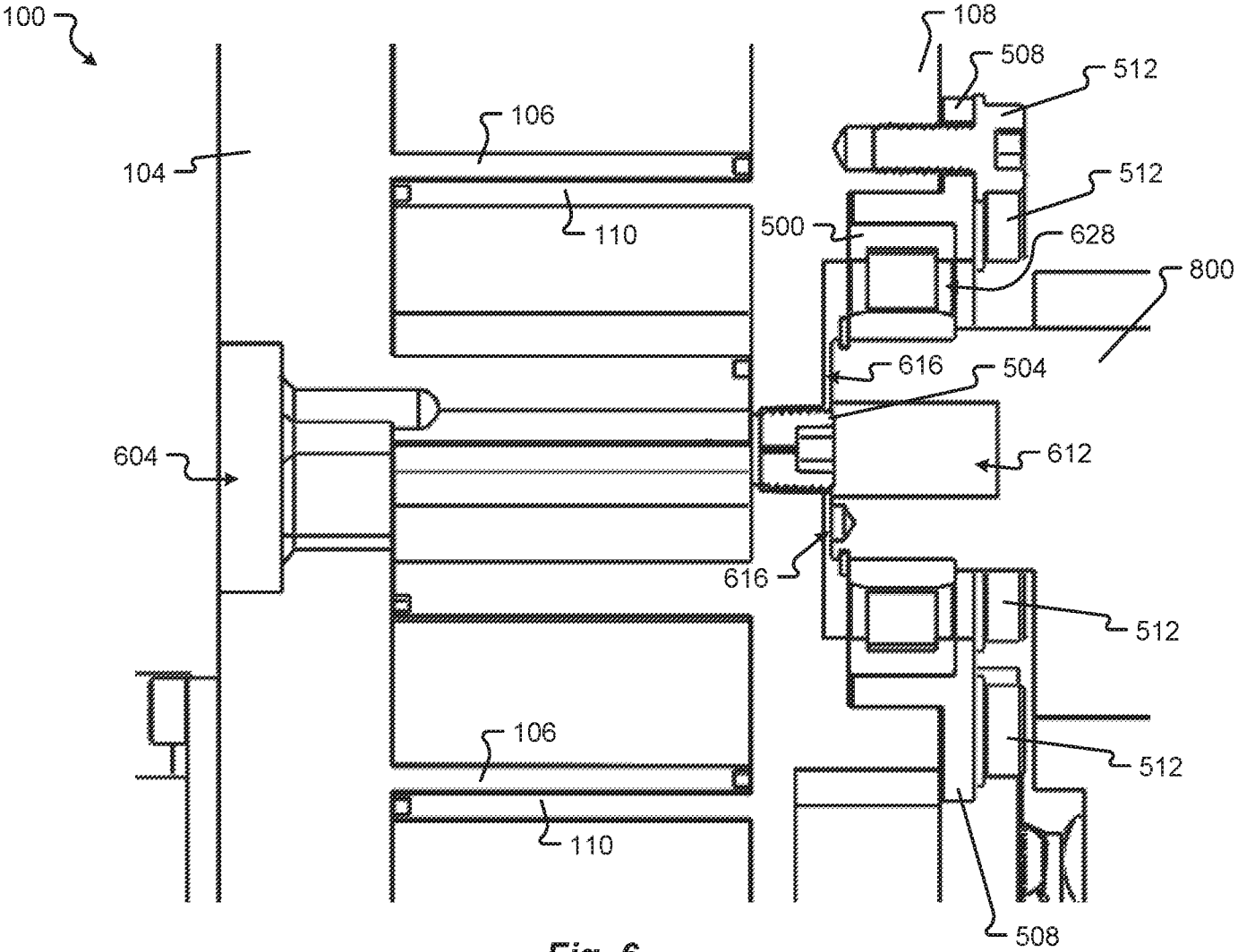
FIG. 6 is a close-up cross-sectional view of a portion of a scroll expander that includes the crankshaft interface, according to at least some embodiments of the present disclosure.

Turning now to FIGS. 5 and 6, a similar lubrication system may be utilized in connection with a crankshaft bearing 500, which supports an end of a crankshaft 800 where the crankshaft 800 interfaces with the orbiting scroll 108. The crankshaft bearing 500 is secured to the orbiting scroll 108 at least in part by virtue of a circular plate 508, which covers the outer race of the crankshaft bearing 500 and is secured to the orbiting scroll 108 via a plurality of threaded fasteners 512. Although threaded fasteners 512 are used in the embodiment of FIGS. 5-6, in other embodiments any other type of mechanical fastener may be used that is suitable for securing the plate 508 to the orbiting scroll 108.

The scroll device 100, when operating as a scroll expander, receives a high-pressure working fluid, via the inlet 604 of the fixed scroll 104, into a central pocket or receptacle formed by the involutes 106 and 110 of the fixed scroll 104 and the orbiting scroll 108, respectively. The high-pressure working fluid pushes against the involutes 106 and 110 and causes the orbiting scroll 108 to orbit relative to the fixed scroll 104, which in turn causes the pocket or receptacle in which the working fluid is located to grow in size, thus allowing the working fluid to expand. Alternatively, when the scroll device 100 is operated as a scroll compressor, a low-pressure working fluid is captured in a pocket or receptacle formed between the involutes 106 and 110 proximate an outer perimeter or circumference thereof. A motor causes the orbiting scroll 108 to orbit relative to the fixed scroll 104, which orbiting motion causes the pocket or receptacle to shrink in size while pushing the working fluid closer and closer to the center of the fixed scroll 104 and the orbiting scroll 108. As a result, in either mode of operation, the working fluid is at the highest pressure when it is located in between the involutes 106 and 110 in the center of the scroll device 100.

Returning to FIGS. 5-6, an orifice plug 504 is provided in a central aperture passing through the center of the orbiting scroll 108 (and thus along or proximate to the axis of the crankshaft bearing 500). The orifice plug 504 permits a small percentage of the high pressure working fluid (which may be, for example, oil or an oil/refrigerant mixture) located between the involutes 106 and 110 at the center of the scroll device 100 to pass through the orbiting scroll 108 and into a lubrication chamber 612 defined within an end of the crankshaft 800. (For clarity, the portion of the working fluid that passes into the lubrication chamber 612 will be hereinafter referred to as lubricant.) From the lubrication chamber 612, the lubricant flows through the space 616 between the crankshaft 800 and the orbiting scroll 108, and then through the crankshaft bearing 500 via the open side 628 thereof, thus lubricating the crankshaft bearing 500.

The orifice in the orifice plug 504 is precisely machined to a desired diameter to provide the appropriate amount of lubricant to the crankshaft bearing 500. In some embodiments, the orifice plug 504 may be easily removed and replaced to change the flow rate of lubricant into the crankshaft bearing 500. A larger metered orifice allows more lubricant to reach the crankshaft bearing 500 in a given period of time, while a smaller metered orifice reduces the amount of lubricant that reaches the crankshaft bearing 500 in a given period of time. As a result, the orifice plug 504 may be sized as desired to ensure that a proper amount of lubricant reaches the crankshaft bearing 500 of a given scroll device 100. Moreover, use of the orifice plug 504 beneficially ensures a constant flow rate of lubricant into the crankshaft bearing 504, thus avoiding problems resulting from an inconsistent lubricant flow rate.

The orifice plug 504 may be made of rubber, plastic, metal, or any other material suitable for sealing the hole in the orbiting scroll 108 in which the orifice plug 504 is located while metering lubricant through an orifice thereof. In some embodiments, the orbiting scroll 108 may comprise internal threads, and the orifice plug 504 may comprise external threads, thus allowing the orifice plug to threadably engage the orbiting scroll 108. In other embodiments, the orifice plug 504 may be configured to engage the orbiting scroll 108 with a friction fit. The orifice plug 504 may comprise a plurality of ridges or flanges around the circumference thereof that are configured to press against the wall of the hole in the orbiting scroll 108 in which the orifice plug 504 is located, and thus enhance the sealing ability of the orifice plug 504 relative to the orbiting scroll 108.

Although the orifice plug 504 is described above as being removable, in other embodiments the orifice plug 504 may be permanently secured within the orbiting scroll 108, whether by welding, pressing, chemical bonding, or otherwise.

Figure 7:
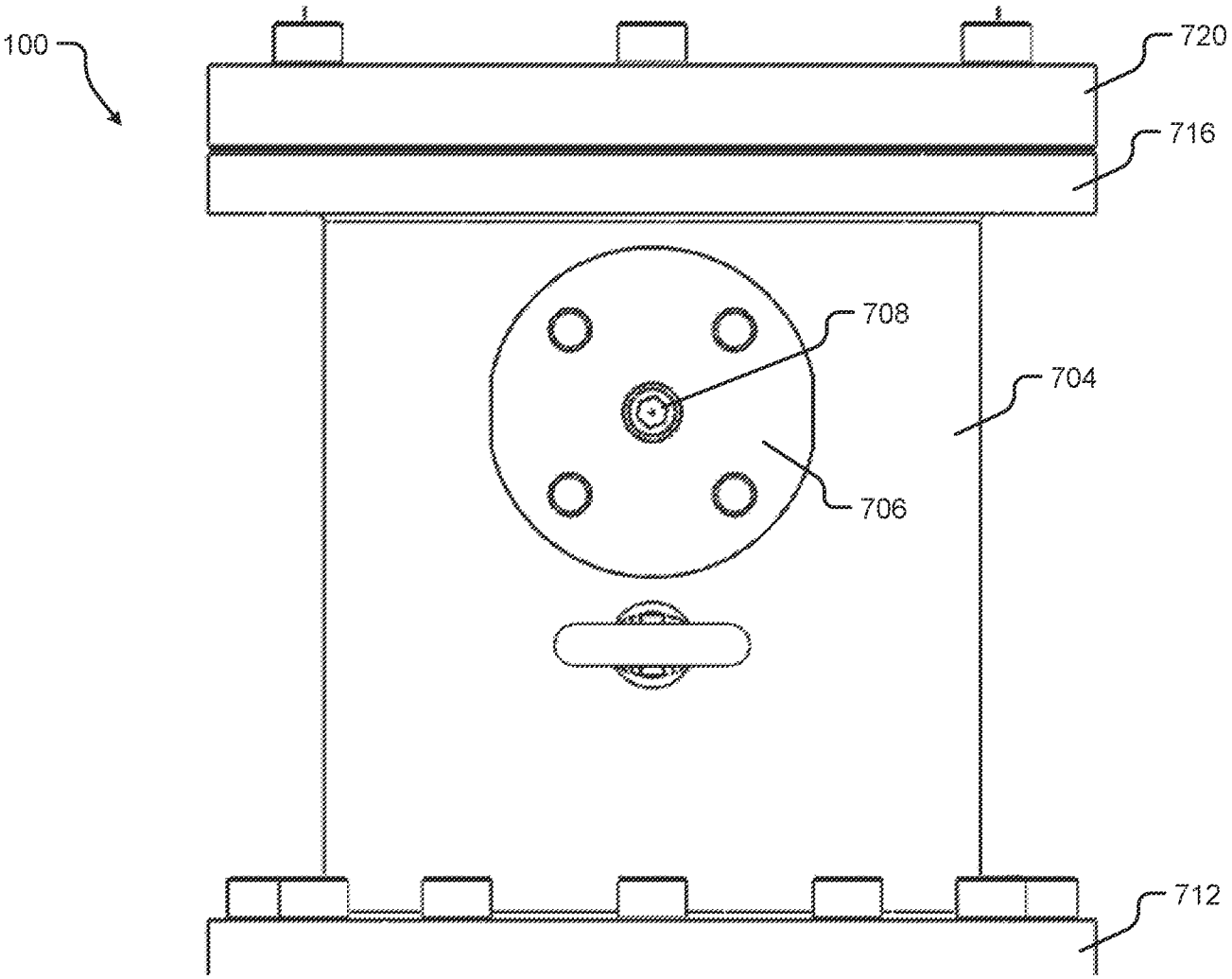
FIG. 7 is a top plan view of a drive bearing housing according to at least some embodiments of the present disclosure.
Figure 8:
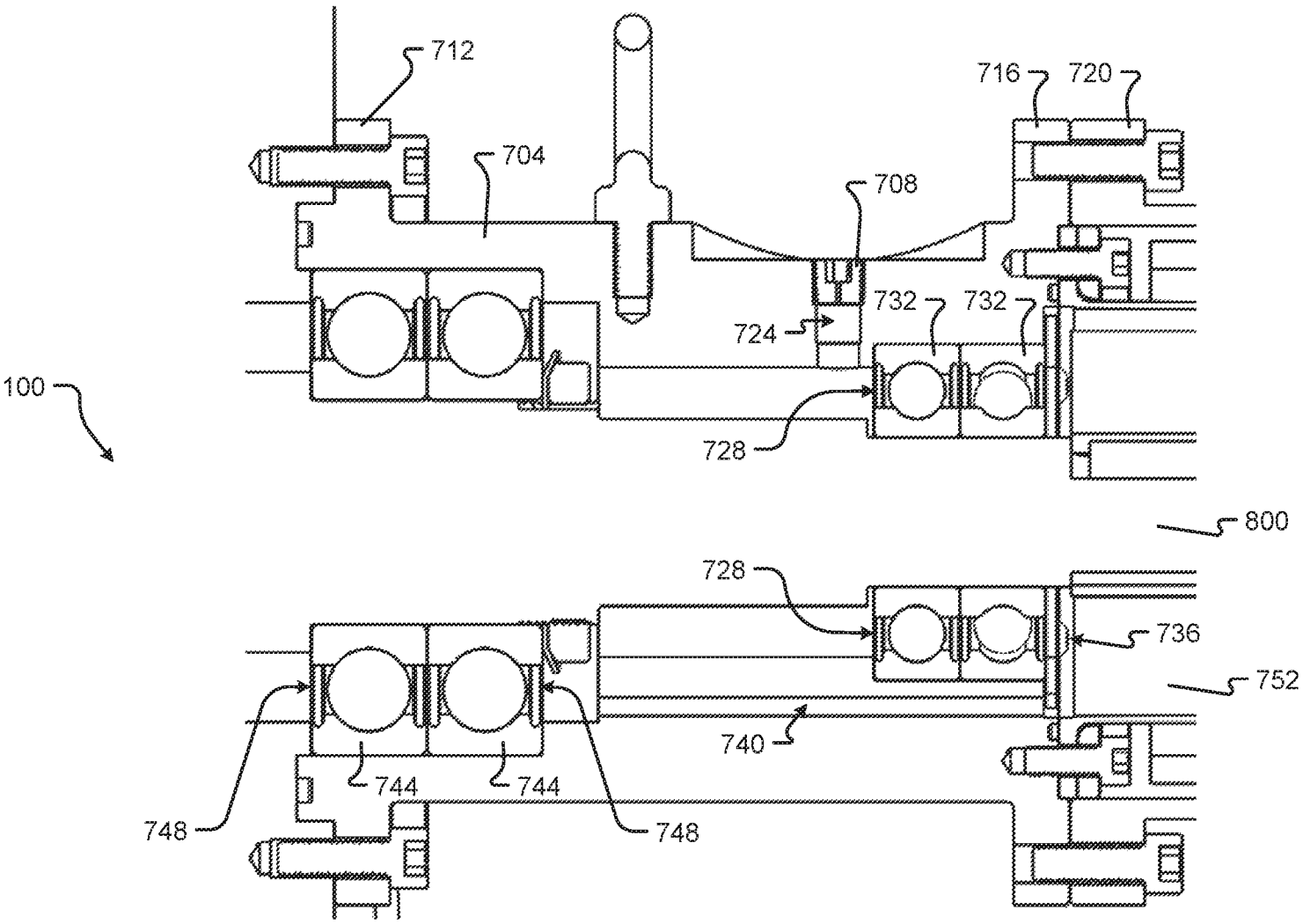
FIG. 8 is a side cross-sectional view of a drive bearing housing according to at least some embodiments of the present disclosure.

With reference now to FIGS. 7-8, the crankshaft 800 through which torque is transmitted from the orbiting scroll 108 to a generator (when the scroll device 100 is being used as a scroll expander) or through which torque is transmitted from a motor to the orbiting scroll 108 (when the scroll device 100 is being used as a scroll compressor) may be supported by a plurality of drive bearings 732 and 744 secured within a crankshaft housing 704. The housing 704 may comprise a scroll housing flange 712 that is secured to the housing 112 of the scroll device 100, and a motor housing flange 716 that is secured to a generator/motor housing 720. The housing 704 also comprises a pipe plug fitting 706. In the center of the pipe plug fitting 706, a channel 724 passes through the crankshaft housing 704. An orifice plug 708 is positioned within this channel 724. Lubricant is pumped through the orifice of the orifice plug 708 before reaching and lubricating the drive bearings 732 and 744.

Within the crankshaft housing 704, a pair of drive bearings 732 supports the crankshaft 800 at one end of the housing 704, and a pair of drive bearings 744 supports the crankshaft 800 at an opposite end of the housing. As with the other bearings described herein, the drive bearings 732 and 744 comprise open sides 728 and 748, through which lubricant may flow into and out of the drive bearings 732 and 748 to lubricate the same.

In operation, lubricant is pumped into the housing 704 via the orifice plug 708 and the channel 724. Inside the housing 704, the lubricant coalesces and flows into the driving bearings 732 via the open side 728 proximate the channel 724. The lubricant then lubricates the drive bearings 732 before draining out of the drive bearings 732 and into a magnetic coupling canister 752 via a small hole 736 in a housing of outer drive bearing 732, from which the lubricant enters the housing drain channel 740. The lubricant flows along the housing drain channel 740 to reach the drive bearings 744. The lubricant flows into the drive bearings 744 via the the open sides 748 thereof, to lubricate the drive bearings 744 before draining into the scroll housing 112 (not shown in FIG. 8), where the lubricant may be collected and either recycled or discarded. The path of the lubricant as described herein beneficially prevents oil stagnation, which would increase the likelihood of bearing contamination.

Although FIG. 8 depicts the crankshaft 800 as being supported by two smaller bearings 732 and two larger bearings 744 within the housing 704, the present disclosure is not so limited. For example, the crankshaft 800 may be supported by a single bearing 732 on one side of the bearing housing and a single bearing 744 on another side of the bearing housing; one or more bearings 732 or 744 positioned in the middle of the bearing housing; and/or any other arrangement of bearings. The bearings 732 and the bearings 744 may or may not be the same size. The bearings 732 and 744 beneficially support the crankshaft 800 as it rotates and reduce or eliminate the transmission of forces other than torque (e.g., vertical and/or horizontal forces) through the crankshaft 800.

Additionally, although a particular flow path of lubricant through the housing 704 is described above, the present disclosure is not limited to the specific flow path described. In some embodiments, for example, lubricant may flow directly into one or more bearings from the channel 724. This may result from the channel 724 being positioned elsewhere on the housing 704, so as to be directly above a bearing 732 or 744, or from a bearing 732 or 744 being positioned directly underneath the channel 724. Additionally, in some embodiments the lubricant may flow through the drive bearings 744 before flowing through the drive bearings 732, or some of the lubricant may flow directly to the drive bearings 744 while some of the lubricant flows directly to the drive bearings 732. In some embodiments, a plurality of channels 724 may extend through the housing 704, which each channel 724 providing lubricant to one or more bearings 732 or 744. In such embodiments, each channel 724 may be provided with an orifice plug 708, having an orifice therein that is sized based on the size of the bearing(s) associated with the channel 724 in which the orifice plug 708 is to be installed, and the desired lubricant flow rate associated with that bearing size (or otherwise associated with the bearing in question). In some embodiments, instead of used lubricant draining into the housing 112 of the scroll device 100, the used lubricant may be collected within the housing 704, from which the used lubricant may be discarded or filtered and recycled.

Scroll devices and their components are, as noted above, often made of aluminum to reduce weight and improve heat transfer. For example, a scroll device 100 may be made from 6061 aluminum, which exhibits high thermal expansion. The high thermal expansion of 6061 aluminum may cause steel ball bearings secured therein to lose press and rotate within the bearing bore, which in turn may cause significant damage that, in some instances, results in scroll failure. To solve this problem, a steel bearing sleeve may beneficially be used in high-temperature applications, as illustrated in FIGS. 9-11 with respect to the bearings 128 supporting a portion of an idler shaft 200 in an orbiting scroll 108 (only a portion of which is shown in FIGS. 9-11).

A large press fit cannot be used between an aluminum housing such as the orbiting scroll 108 (or any other aluminum housing, such as the fixed scroll 104) and a bearing 128 (or another bearing, such as the bearing 124), because the high stress applied to the outer race 908 of the bearing 128 reduces the bearing internal clearance and therefore decreases bearing life. According to embodiments of the present disclosure, a steel bearing sleeve 904 is used to allow for a greater press fit between the orbiting scroll 108 and the steel bearing sleeve 904 without affecting the press fit between the steel bearing sleeve 904 and the bearing 128. Moreover, the steel bearing sleeve 904 may be manufactured from a steel with a similar coefficient of thermal expansion as the bearing 128 so that high temperatures do not affect the press fit between the steel bearing sleeve 904 and the bearing 128.

Figure 9:
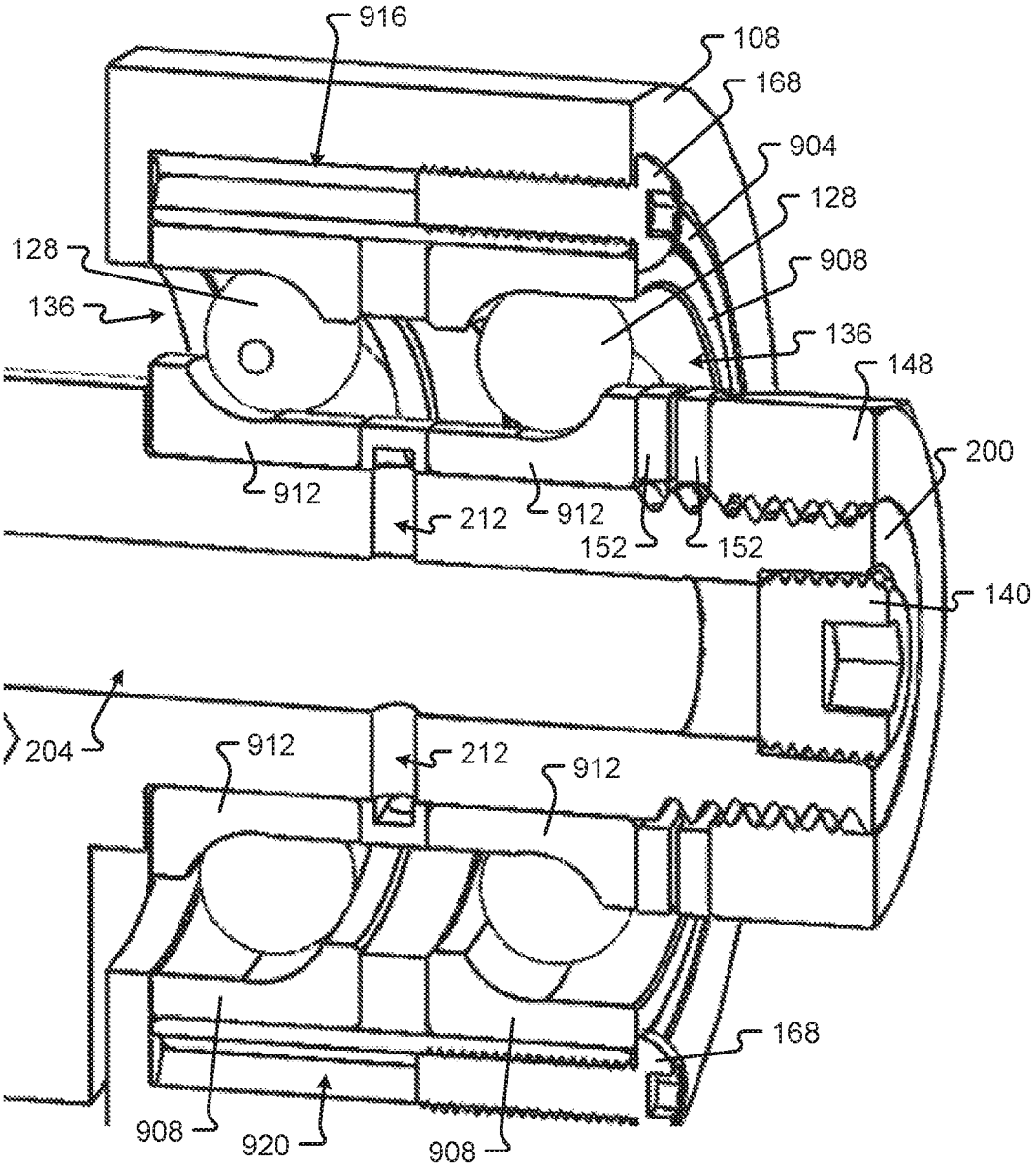
FIG. 9 is a perspective cross-sectional view of a portion of a scroll device according to at least some embodiments of the present disclosure.
Figure 10:
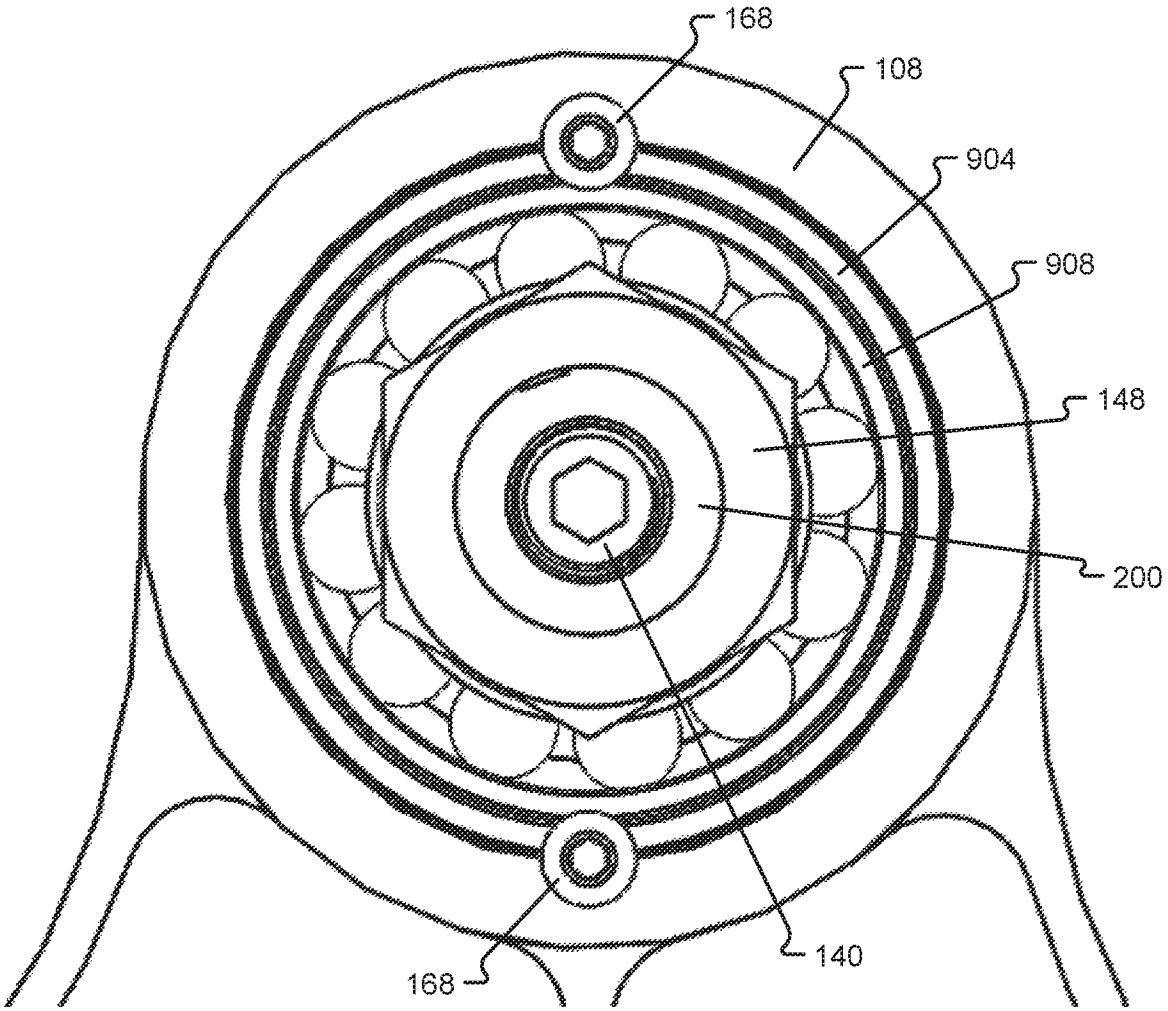
FIG. 10 is a front view of a portion of a scroll device according to at least some embodiments of the present disclosure.
Figure 11:
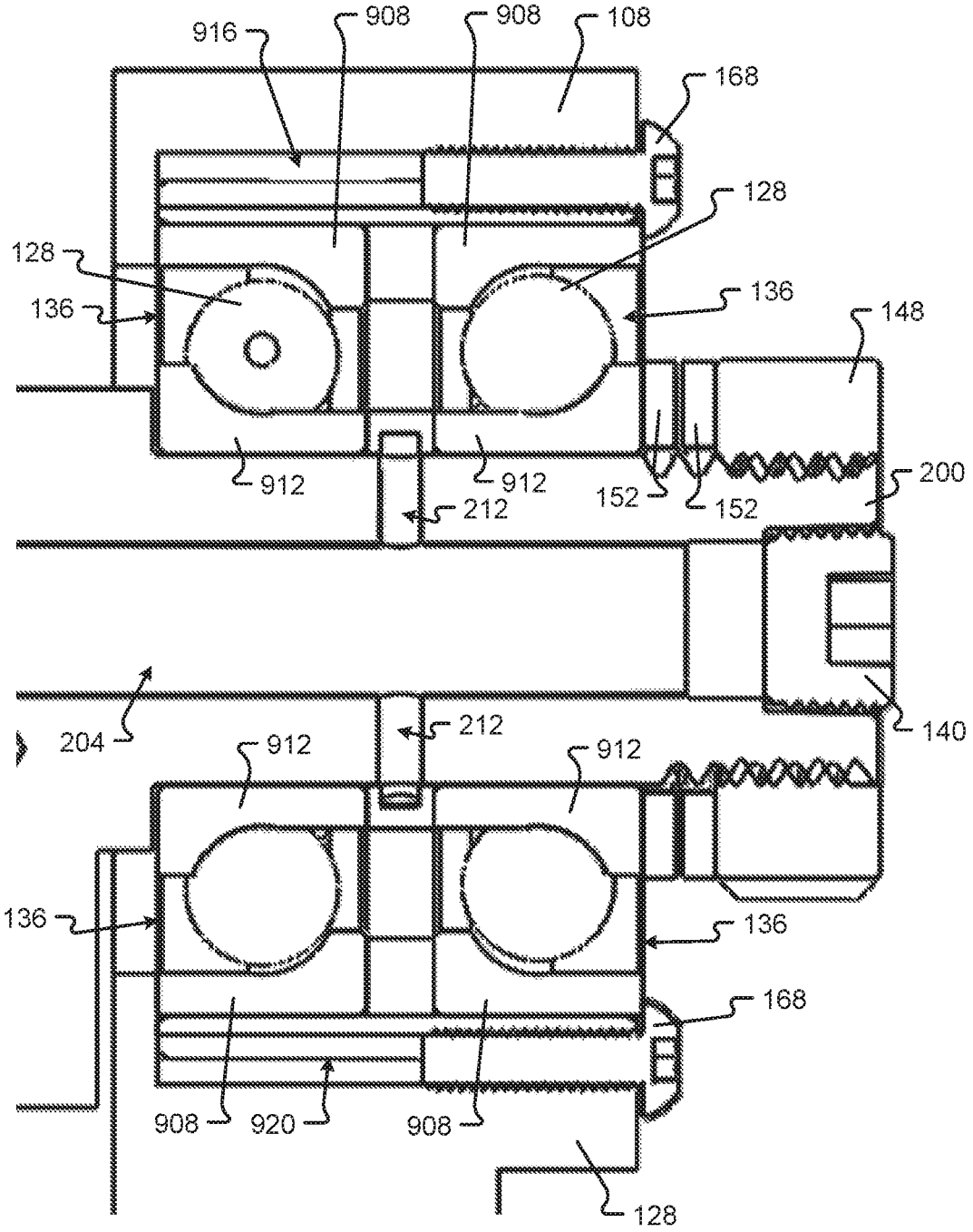
FIG. 11 is a side cross-sectional view of a portion of a scroll device according to at least some embodiments of the present disclosure.

As shown in FIGS. 9-11, the steel bearing sleeve 904 surrounds the outer races 908 of the bearings 128 within the orbiting scroll 108. An inner race 912 of each bearing 128 is secured to the idler shaft 200. Descriptions of many aspects of the idler shaft 200, the bearing 128, and other components shown in FIGS. 9-11 are provided above and, although applicable to the present embodiment (unless contradictory to the following discussion), are not repeated here.

Where a sleeve press fit is not sufficient to hold the steel bearing sleeve 904 in place, whether due to the expected thermal expansion of the orbiting scroll 108 or other aluminum housing, or otherwise, sleeve anti-rotation pins or fasteners may be used to prevent sleeve radial and axial movement. In the embodiment of FIGS. 9-11, holes 916 and 920 are drilled between the orbiting scroll 108 or other aluminum housing and the steel bearing sleeve 904. The holes 916 and 920 are at least partially threaded, and fasteners 168 are threadably engaged therewith. The fasteners 168 secure the steel bearing sleeve 904 to the orbiting scroll 108 or other aluminum housing both axially (e.g., so as to prevent movement of the steel bearing sleeve 904 in and out of the orbiting scroll 108 or other aluminum housing) and radially (e.g., so as to prevent rotation of the steel bearing sleeve 904 relative to the orbiting scroll 108 or other aluminum housing).

In some embodiments, the steel bearing sleeve 904 is machined with extra material on the internal dimension. The steel bearing sleeve 904 may then be pressed into a fixed scroll 104 or orbiting scroll 108 after rough machining of the involutes of the fixed scroll 104 or orbiting scroll 108, respectively, have taken place. The scroll involute and bearing bores may then undergo final machining during the same operation for high accuracy. Before the aluminum scrolls are anodized, aluminum caps are placed over the bearing bores to prevent the corrosive fluid from contacting the steel bearing sleeve 904. Once the scrolls have been anodized, the caps are removed and reused for future production orders. This process reduces scroll warping that occurs when a sleeve is pressed into a scroll, which warping distorts the involute and leads to premature scroll failure. By conducting final machining of the steel bearing sleeves 904 after the steel bearing sleeves 904 have been pressed into the scrolls, scroll warping may be mitigated or avoided.

Embodiments of the present disclosure comprise a scroll device with active oil lubrication for all internal bearings.

Embodiments of the present disclosure comprise a scroll device with oil passages integrated into the idler shafts.

Embodiments of the present disclosure comprise a scroll device with oil metering plugs to provide predictable oil flow to each bearing.

Embodiments of the present disclosure comprise a scroll device with an oil passage from the expander inlet area to the crankshaft bearing.

Embodiments of the present disclosure comprise a scroll device with oil return paths machined into the bearing housing.

Embodiments of the present disclosure comprise a scroll device with steel bearing sleeves to prevent stationary bearing races from rotating.

Embodiments of the present disclosure comprise a scroll device with steel bearing sleeves with fasteners to provide axial and radial compliance.

Embodiments of the present disclosure comprise a scroll device with steel bearings sleeves installed prior to scroll final machining.

Embodiments of the present disclosure comprise a scroll device with aluminum bearing bore caps to protect the steel bearing sleeves from the anodize bath.

Embodiments of the present disclosure include a scroll device comprising: a fixed scroll comprising at least one first bearing; an orbiting scroll comprising at least one second bearing; an eccentric idler shaft having a first arm terminating at a first end and supported by the at least one first bearing and a second arm terminating at a second end and supported by the least one second bearing, the eccentric idler shaft comprising a hollow core extending from the first end to the second end; at least one first channel extending through the first arm and enabling fluid communication between the hollow core and the at least one first bearing; and at least one second channel extending through the second arm and enabling fluid communication between the hollow core and the least one second bearing.

Aspects of the foregoing scroll device include: an idler shaft cap secured to the fixed scroll, the idler shaft cap defining a central passageway in fluid communication with the hollow core; an orifice plug removably secured within the central passageway; a plug removably secured within the hollow core proximate the second end, the plug preventing fluid flow out of the hollow core at the second end; wherein the hollow core comprises a first portion extending through the first arm and having a first axis, and a second portion extending through the second arm and having a second axis; wherein the at least one first bearing comprises open sides that enable fluid flow through the at least one first bearing; wherein the at least one second bearing comprises open sides that enable fluid flow through the at least one second bearing; wherein the at least one first channel comprises two oppositely disposed first channels, and the at least one second channel comprises two oppositely disposed second channels; wherein the orbiting scroll further comprises: a crankshaft bearing having a crankshaft bearing axis, the crankshaft bearing having open sides that enable fluid flow through the crankshaft bearing, and an orifice plug removably secured within a central aperture passing through the orbiting scroll, the orifice plug substantially aligned with the crankshaft bearing axis; and a crankshaft having a first crankshaft end defining a lubrication chamber, wherein the first crankshaft end is supported by the crankshaft bearing.

Aspects of the foregoing scroll device also include: a crankshaft housing comprising opposite ends and a central axis, with a first drive bearing secured within the crankshaft housing proximate one of the opposite ends and a second drive bearing secured within the crankshaft housing proximate another of the opposite ends; a crankshaft rotatably secured to the orbiting scroll, the crankshaft extending through the crankshaft housing and supported by the first drive bearing and the second drive bearing; a channel extending radially through the crankshaft housing; and an orifice plug removably secured within the channel, wherein the orifice plug, the first drive bearing, and the second drive bearing are in fluid communication.

Embodiments of the present disclosure also include a scroll device comprising: a fixed scroll; an orbiting scroll; and an eccentric idler shaft orbitally connecting the orbiting scroll to the fixed scroll, the eccentric idler shaft comprising: a central portion having a first side and a second side opposite the first side; a first arm extending from the first side and terminating in a first end, the first arm having a first axis; a second arm extending from the second side and terminating in a second end, the second arm having a second axis offset from and parallel to the first axis; a hollow core extending from the first end to the second end; a plurality of first channels extending through the first arm from the hollow core to an exterior of the eccentric idler shaft; and a plurality of second channels extending through the second arm from the hollow core to an exterior of the eccentric idler shaft.

Aspects of the foregoing scroll device include: wherein the fixed scroll comprises a first bearing that supports the first arm of the eccentric idler shaft, and the orbiting scroll comprises a second bearing that supports the second arm of the eccentric idler shaft; wherein at least one of the first bearing and the second bearing is surrounded by a steel bearing sleeve; a plug positioned within the hollow core proximate the second end to close the second end to fluid flow; an orifice plug positioned to meter lubricant flow into the hollow core; an idler shaft cap secured to the fixed scroll, the idler shaft cap defining a central passageway in fluid communication with the hollow core; and an orifice plug removably secured within the central passageway.

Embodiments of the present disclosure further include a scroll device comprising: a fixed scroll comprising a first idler shaft bearing; an orbiting scroll comprising a second idler shaft bearing; and a lubrication channel comprising: an orifice through an orifice plug; a hollow core of an eccentric idler shaft; a first plurality of channels extending through the eccentric idler shaft proximate the first idler shaft bearing; and a second plurality of channels extending through the eccentric idler shaft proximate the second idler shaft bearing.

Aspects of the foregoing scroll device include: wherein the lubrication channel further comprises opposite open sides of at least one of the first idler shaft bearing and the second idler shaft bearing.

Ranges have been discussed and used within the forgoing description. One skilled in the art would understand that any sub-range within the stated range would be suitable, as would any number or value within the broad range, without deviating from the invention. Additionally, where the meaning of the term "about" as used herein would not otherwise be apparent to one of ordinary skill in the art, the term "about" should be interpreted as meaning within plus or minus five percent of the stated value.

Throughout the present disclosure, various embodiments have been disclosed. Components described in connection with one embodiment are the same as or similar to like-numbered components described in connection with another embodiment.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description, for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

Any of the steps, functions, and operations discussed herein can be performed continuously and automatically.

What is claimed is:

1. A scroll device comprising:

a fixed scroll comprising at least one first bearing;

an orbiting scroll comprising at least one second bearing and a first orifice plug removably secured within a central aperture passing through the orbiting scroll;

an eccentric idler shaft having a first arm terminating at a first end and supported by the at least one first bearing and a second arm terminating at a second end and supported by the at least one second bearing, the eccentric idler shaft comprising a hollow core extending from the first end to the second end;

at least one first channel extending through the first arm and enabling fluid communication between the hollow core and the at least one first bearing;

at least one second channel extending through the second arm and enabling fluid communication between the hollow core and the at least one second bearing; and a crankshaft bearing having a crankshaft bearing axis, the crankshaft bearing having open sides that enable fluid flow through the crankshaft bearing, wherein the first orifice plug is substantially aligned with the crankshaft bearing axis.

2. The scroll device of claim 1, further comprising an idler shaft cap secured to the fixed scroll, the idler shaft cap defining a central passageway in fluid communication with the hollow core.

3. The scroll device of claim 2, further comprising a second orifice plug removably secured within the central passageway.

4. The scroll device of claim 1, further comprising a seal plug removably secured within the hollow core proximate the second end, the seal plug preventing fluid flow out of the hollow core at the second end.

5. The scroll device of claim 1, wherein the hollow core comprises a first portion extending through the first arm and having a first axis, and a second portion extending through the second arm and having a second axis.

6. The scroll device of claim 1, wherein the at least one first bearing comprises open sides that enable fluid flow through the at least one first bearing.

7. The scroll device of claim 1, wherein the at least one second bearing comprises open sides that enable fluid flow through the at least one second bearing.

8. The scroll device of claim 1, wherein the at least one first channel comprises two oppositely disposed first channels, and the at least one second channel comprises two oppositely disposed second channels.

9. The scroll device of claim 1, further comprising a crankshaft having a first crankshaft end defining a lubrication chamber, wherein the first crankshaft end is supported by the crankshaft bearing.

10. The scroll device of claim 1, further comprising:

a crankshaft housing comprising opposite ends and a central axis, with a first drive bearing secured within the crankshaft housing proximate one of the opposite ends and a second drive bearing secured within the crankshaft housing proximate another of the opposite ends;

a crankshaft rotatably secured to the orbiting scroll, the crankshaft extending through the crankshaft housing and supported by the first drive bearing and the second drive bearing;

a channel extending radially through the crankshaft housing; and a third orifice plug removably secured within the channel, wherein the third orifice plug, the first drive bearing, and the second drive bearing are in fluid communication.

11. A scroll device comprising:

a fixed scroll;

an orbiting scroll having a first orifice plug removably secured within a central aperture passing through the orbiting scroll;

a crankshaft bearing having a crankshaft bearing axis, the crankshaft bearing having open sides that enable fluid flow through the crankshaft bearing, wherein the first orifice plug is substantially aligned with the crankshaft bearing axis; and an eccentric idler shaft orbitally connecting the orbiting scroll to the fixed scroll, the eccentric idler shaft comprising:

a central portion having a first side and a second side opposite the first side;

a first arm extending from the first side and terminating in a first end, the first arm having a first axis;

a second arm extending from the second side and terminating in a second end, the second arm having a second axis offset from and parallel to the first axis;

a hollow core extending from the first end to the second end;

a plurality of first channels extending through the first arm from the hollow core to an exterior of the eccentric idler shaft; and a plurality of second channels extending through the second arm from the hollow core to an exterior of the eccentric idler shaft.

12. The scroll device of claim 11, wherein the fixed scroll comprises a first bearing that supports the first arm of the eccentric idler shaft, and the orbiting scroll comprises a second bearing that supports the second arm of the eccentric idler shaft.

13. The scroll device of claim 12, wherein at least one of the first bearing and the second bearing is surrounded by a steel bearing sleeve.

14. The scroll device of claim 11, further comprising a seal plug positioned within the hollow core proximate the second end to close the second end to fluid flow.

15. The scroll device of claim 11, further comprising a second orifice plug positioned to meter lubricant flow into the hollow core.

16. The scroll device of claim 11, further comprising an idler shaft cap secured to the fixed scroll, the idler shaft cap defining a central passageway in fluid communication with the hollow core.

17. The scroll device of claim 16, further comprising a second orifice plug removably secured within the central passageway.

18. A scroll device comprising:

a fixed scroll comprising a first idler shaft bearing;

an orbiting scroll comprising a second idler shaft bearing and a first orifice plug removably secured within a central aperture passing through the orbiting scroll;

a crankshaft bearing having a crankshaft bearing axis, the crankshaft bearing having open sides that enable fluid flow through the crankshaft bearing, wherein the first orifice plug is substantially aligned with the crankshaft bearing axis; and a lubrication channel comprising:

an orifice through a second orifice plug;

a hollow core of an eccentric idler shaft;

a first plurality of channels extending through the eccentric idler shaft proximate the first idler shaft bearing; and a second plurality of channels extending through the eccentric idler shaft proximate the second idler shaft bearing.

19. The scroll device of claim 18, wherein the lubrication channel further comprises opposite open sides of at least one of the first idler shaft bearing and the second idler shaft bearing.

20. The scroll device of claim 18, further comprising an idler shaft cap secured to the fixed scroll, the idler shaft cap defining a central passageway in fluid communication with the hollow core, and wherein the second orifice plug is removably secured within the central passageway.

* * * * *